US009856639B2

(12) United States Patent
Koszo

(10) Patent No.: US 9,856,639 B2
(45) Date of Patent: Jan. 2, 2018

(54) WALL ASSEMBLY AND A BUILDING STRUCTURE INCLUDING THE WALL ASSEMBLY

(71) Applicant: Nandor Koszo, Shalier Park (AU)

(72) Inventor: Nandor Koszo, Shalier Park (AU)

( * ) Notice: Subject to any disclaimer, the term of this patent is extended or adjusted under 35 U.S.C. 154(b) by 0 days.

(21) Appl. No.: 14/420,170

(22) PCT Filed: Aug. 7, 2013

(86) PCT No.: PCT/AU2013/000870

§ 371 (c)(1),
(2) Date: Feb. 6, 2015

(87) PCT Pub. No.: WO2014/022884

PCT Pub. Date: Feb. 13, 2014

(65) Prior Publication Data

US 2015/0204085 A1 Jul. 23, 2015

(30) Foreign Application Priority Data

Aug. 7, 2012 (AU) ..... 2012903377

(51) Int. Cl.
*E04B 1/16* (2006.01)
*E04B 2/86* (2006.01)
(Continued)

(52) U.S. Cl.
CPC ..... *E04B 1/165* (2013.01); *E04B 1/167* (2013.01); *E04B 2/38* (2013.01); *E04B 2/40* (2013.01);
(Continued)

(58) Field of Classification Search
CPC ..... E04B 2/28; E04B 2/30; E04B 2/38; E04B 2/40; E04B 2/84; E04B 2/68; E04B 2/86;
(Continued)

(56) References Cited

U.S. PATENT DOCUMENTS 1,353,702 A * 9/1920 Aschauer ..... E04B 2/28
405/273
2,267,651 A * 12/1941 Hallisy ..... E04G 13/02
249/160
(Continued)

FOREIGN PATENT DOCUMENTS

AU 2762484 A 11/1984
AU WO 9202701 A1 * 2/1992 ..... E04B 1/3505
(Continued)

OTHER PUBLICATIONS

International Search Report and Written Opinion for Application No. PCT/AU2013/000870 dated Oct. 17, 2013.

*Primary Examiner* — Andrew J Triggs
(74) *Attorney, Agent, or Firm* — Lerner, David, Littenberg, Krumholz & Mentlik, LLP

(57) ABSTRACT

A wall assembly for forming an external wall on a building structure is disclosed. The wall assembly comprises a cladding and a plurality of vertical formwork members spaced along the wall assembly, and a horizontal formwork member extending along the top of the wall assembly. The formwork members are elongate profiles having a substantially constant cross sectional shape and they are arranged so that with the cladding they form an interconnected formwork defining a formwork space. A cementitious material cast within the formwork space is interconnected and forms a single underlying structural frame within the constructed wall assembly. The assembly includes connectors extending between the vertical and horizontal formwork members and the cladding on which they are mounted. Each connector extends from the cladding through the formwork space to the formwork member and is cast within the cementitious material. A method of building a wall assembly is also disclosed.

18 Claims, 16 Drawing Sheets

(51) Int. Cl.

| | |
|---|---|
| ***E04B 2/68*** | (2006.01) |
| ***E04B 2/40*** | (2006.01) |
| ***E04B 2/38*** | (2006.01) |
| ***E04B 2/84*** | (2006.01) |
| ***E04G 11/06*** | (2006.01) |

(52) U.S. Cl.
CPC ..... *E04B 2/68* (2013.01); *E04B 2/84* (2013.01); *E04B 2/8647* (2013.01); *E04G 11/06* (2013.01); *E04G 2011/067* (2013.01)

(58) Field of Classification Search
CPC .... E04B 2/8611; E04B 2/8617; E04B 2/8623; E04B 2/8629; E04B 2/8635; E04B 2/8647; E04B 1/16; E04B 1/165; E04B 1/167; E06G 13/02; E04G 11/06
See application file for complete search history.

(56) References Cited

U.S. PATENT DOCUMENTS 2,741,821 A 4/1956 Findley
2,939,500 A * 6/1960 Grant ..... E04G 13/02 249/19
3,614,049 A * 10/1971 Keyston ..... E04G 13/02 249/19
4,226,061 A 10/1980 Day, Jr.
4,409,764 A * 10/1983 Wilnau ..... E04L 31/165 52/127.3
4,823,534 A 4/1989 Hebinck
5,381,635 A 1/1995 Sanger
5,729,942 A 3/1998 Moore, Jr.
5,799,543 A 9/1998 Nagai et al.
5,806,266 A * 9/1998 Jennings ..... E04G 11/062 249/155
5,899,037 A * 5/1999 Josey ..... E04B 2/58 428/118
6,003,278 A * 12/1999 Weaver ..... E04C 2/382 249/26
6,223,480 B1 5/2001 Khoo
6,338,231 B1 1/2002 Enriquez
6,427,406 B1 * 8/2002 Weaver ..... B28B 19/003 52/251
6,494,004 B1 * 12/2002 Zimmerman ..... B28B 19/003 249/26
6,878,323 B2 * 4/2005 Fyfe ..... E04C 5/07 156/184
7,146,773 B2 * 12/2006 Wilson ..... E04B 2/8623 249/155
7,530,203 B1 * 5/2009 Hare ..... B28B 19/003 52/250
8,713,871 B2 * 5/2014 Wallin ..... E02D 29/0275 52/250
8,800,227 B2 * 8/2014 LeBlang ..... E04B 1/165 52/309.11
8,844,223 B2 * 9/2014 Zhong ..... E04B 1/161 52/259
8,863,445 B2 * 10/2014 Zhong ..... E04B 1/165 52/79.14
9,038,339 B2 * 5/2015 Zhong ..... E04B 1/161 52/204.1
2003/0089066 A1 * 5/2003 Nelson ..... E04B 1/161 52/424
2007/0062134 A1 3/2007 Chung
2009/0107065 A1 * 4/2009 LeBlang ..... E04B 1/165 52/252
2011/0088333 A1 * 4/2011 Damichey ..... E04B 1/04 52/79.11
2011/0099927 A1 * 5/2011 Garcia Viar ..... E04B 2/8647 52/220.2
2011/0099932 A1 * 5/2011 Saulce ..... E04B 2/845 52/426
2012/0047816 A1 * 3/2012 Zhong ..... E04B 1/161 52/11
2015/0204085 A1 * 7/2015 Koszo ..... E04B 1/165 52/742.14

FOREIGN PATENT DOCUMENTS

| | | | | |
|---|---|---|---|---|
| EP | 0487422 | A1 | 5/1992 | |
| FR | 1040182 | A | 10/1953 | |
| GB | 161631 | A | 4/1921 | |
| GB | 423431 | A | 1/1935 | |
| JP | 07116749 | | 12/1995 | |
| WO | 9202701 | A1 | 2/1992 | |
| WO | WO 9202701 | A1 * | 2/1992 | ..... E04G 13/02 |
| WO | 2011127522 | A1 | 10/2011 | |

* cited by examiner

WALL ASSEMBLY AND A BUILDING STRUCTURE INCLUDING THE WALL ASSEMBLY

CROSS REFERENCE TO RELATED APPLICATIONS

The present application is a national entry under 35 U.S.C. §371 of International Application No. PCT/AU2013/000870 filed Aug. 7, 2013, published in English, which claims the benefit of and priority to Australian Patent Application No. 2012903377, filed Aug. 7, 2012, the entire disclosures of which are hereby incorporated by reference herewith.

FIELD

The present disclosure relates to a wall assembly and a method of building a wall assembly. The present disclosure extends to a building structure including a wall assembly. Further the present disclosure also extends to a wall unit for use in building the wall assembly.

The present disclosure relates particularly but not exclusively to a wall assembly for use in building a building structure that is a detached building for residential accommodation such as a house. It will therefore be convenient to hereinafter describe embodiments of the invention with reference to this example application. However at the same time it must be recognized that the invention is capable of broader application. For example the present disclosure also extends to multi-storey building structures. It also extends to wall assemblies generally and is not limited to wall assemblies for building structures.

Definitions

In the specification the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

In this specification the term "frame" or "structural frame" shall be interpreted broadly and can include two or more frame members. While it includes a light frame for a building it is not to be limited to this particular form of a frame.

In this specification the term "cementitious material" shall be interpreted broadly and shall refer to any cement based material that can be dispensed into a formwork space and occupies and takes on the character of that space. It shall include but not be limited to concrete.

In this specification the term "formwork member" shall be interpreted broadly. It shall include all manner of members that can be used to form a formwork for receiving a material therein. Further it includes components that form a permanent component of a structure. It is not to be limited to components that are used temporarily in the construction of a wall and then removed. Further it shall include members made of all types and forms of material and is not limited to steel.

BACKGROUND

One conventional method of construction of a building involves erecting a light frame of structural elements. The light frame forms an underlying skeleton or support structure for the building. Some of the structural elements are vertically extending and are called studs or posts. Other structural members are horizontally extending and are called plates. The studs and plates are often formed of timber members and are cut to size and then assembled into the light frame by a carpenter who is qualified in building house frames.

Light frame construction using standardised dimensional timber has become the dominant construction method in North America and Australia because of its economy and low cost. The use of minimal structural materials to form the light frame enables builders to enclose a large area at minimal cost.

Once the light frame has been assembled, a wall for the structure is formed comprising inner and outer wall coverings. The outer wall covering may comprise a brick veneer or an arrangement of timber boards. The inner wall covering may comprise sheets of plasterboard, often called GYPROCK, which are fastened to the studs and plates of the frame.

The use of this building technique has a number of well documented shortcomings. The dimensional tolerance of timber frame structures is not very precise. This can lead to difficulties during later stages of the building operation. Further timber is prone to warping and changing shape when it gets wet. If a timber frame is exposed to moisture during the building phase it can deform out of shape. Yet further timber, particularly soft timber, has a limited life time and is not as long lasting as say concrete material.

Furthermore the tolerance or accuracy with which the frame is constructed varies considerably depending on the individual skill of the particular carpenter doing the job.

Further the timber frame is built by carpenters who essentially build the frame up from timber planks. The carpenter cuts the planks to size and progressively builds up the framed structure. The process is quite time consuming and therefore the labour cost of erecting the light frame is considerable. It is also imprecise and the dimensional tolerance or accuracy with which the frame is constructed varies considerably depending on the individual skill and expertise of the particular carpenter doing the job. Further if a brick veneer is required to form the outer layer of the building, then another trade namely a bricklayer is required to lay the bricks of the outer layer. The need to use different trades generally leads to longer construction times for building houses.

Yet further another shortcoming of a timber frame is that it is light and accordingly has limited strength. This strength may be tested in extreme weather events such as a cyclone. It would therefore be advantageous if a stronger frame than a timber frame could be devised, particularly so in areas exposed to hurricanes and cyclones.

Clearly it would be advantageous if a new basic building unit could be devised for building wall assemblies and buildings that at least ameliorated the shortcomings of the prior art structures and building method described above.

SUMMARY

According to one aspect of the present disclosure there is provided a wall assembly comprising:

a cladding and at least one formwork member mounted on the cladding, wherein the formwork member is arranged so that the formwork member forms at least part of a formwork defining a formwork space which receives a cementitious material therein and forms an elongate structural member within the constructed wall assembly.

The formwork member and the cladding may together form the formwork. That is the formwork member and the cladding each form a part of the formwork so that together they form a retaining formwork into which a material can be poured, e.g. the formwork member contributes part of the formwork and the cladding contributes the remainder of the formwork.

The wall assembly may include a plurality of formwork members forming the formwork defining the formwork space, and the cementitious material contained in the formwork members may form a plurality of integrally formed elongate structural members forming a structure, e.g. such as a frame.

The wall assembly may include at least one connector extending between one formwork member and the cladding on which it is mounted, and the connector may extend from the cladding through the formwork space where it is surrounded by cementitious material to the formwork member.

Each connector may be elongate and have two ends and the connector may be fixed to the cladding towards one end thereof and to the formwork member towards the other end thereof.

Each connector may be passed through the cladding and be engaged with the cladding material towards said one end thereof whereby to fix the connector to the cladding member.

Each formwork member may have a plurality of connectors mounted thereon, and the plurality of connectors may be spaced apart in the longitudinal direction of the formwork member to form a row of connectors.

Further one or more formwork members may have two or more connectors mounted thereon that are spaced apart across the width of the formwork member transverse to the longitudinal direction of the formwork member. Optionally the formwork members may have two or more rows of connectors that are spaced apart across the width of the formwork member.

The wall assembly may include a plurality of substantially vertically extending formwork members that are spaced from each other in a direction of length of the wall assembly. The wall assembly may further include at least one substantially horizontally extending formwork member extending in a direction of length off the wall assembly. In embodiments where the wall assembly includes a plurality of substantially vertically extending formwork members and at least one substantially horizontally extending formwork member, the horizontal formwork member may be arranged so as to form an interconnected formwork and formwork space with the vertically extending formwork members whereby to form a single interconnected structure of cementitious material in the formwork space.

The vertically extending formwork members may form vertical support posts in the interconnected structure and the horizontal extending formwork member may form a horizontally extending beam in the interconnected structure.

The wall assembly may include one or more reinforcing rods within the formwork space defined by the formwork member.

The wall assembly may include a wall support on which the cladding and the formwork members are mounted, and the wall assembly may also include a plurality of vertically extending formwork members having vertical reinforcing rods therein which rods are anchored to the wall support whereby to anchor the wall assembly to the wall support.

One or more of the vertically extending formwork members may include a plurality of connectors extending across the formwork space defined by the formwork member, and the formwork members may also have a vertical reinforcing rod received therein, and the connectors may be fixed to the vertical reinforcing rod in the formwork space, e.g. prior to the cementitious material being poured into the formwork space.

The horizontally extending formwork member may include a horizontal reinforcing rod received in the formwork space and extending in a longitudinal direction of length of the horizontal formwork member.

The horizontal formwork member may include a plurality of connectors extending from the horizontal formwork member through the formwork space to the cladding at intervals along the length of the horizontal formwork member, and one or more connectors may be fixed to the horizontal reinforcing rod in the formwork space, e.g. prior to the cementitious material being poured into the formwork.

Further the horizontal reinforcing rod may be fixed to one or more of the vertical reinforcing rods thereby to brace the horizontal reinforcing rod to the vertical reinforcing rods and the wall support. Connection of the connectors to the vertical and horizontal reinforcing rods, and the vertical and horizontal reinforcing rods to each other, and strengthens the constructed wall assembly.

One or more of the formwork members may be in the form of an elongate profile having a substantially constant cross sectional shape.

One or more of the formwork members may be configured in the form of a channel including channel sides joined by a channel base, e.g. a U-shaped channel. Further one or more other formwork members may be configured in the form of an angle section including a take away face and a cross face at an end of the take away face, e.g. an L-shaped angle section.

Further one or more of the formwork members may include mounting flanges extending along longitudinal edges thereof, and fastening elements that are passed through the mounting flanges and into the cladding to fix the formwork member/s to the cladding.

Conveniently but not necessarily the formwork members comprise structural steel profiles, e.g. that can be purchased from steel suppliers as standard items. Instead the formwork members may be made from polymeric materials, e.g. including plastics and in particular recycled plastics.

The cladding may comprise a plurality of cladding members arranged in one or more horizontally extending rows, and each cladding member may be mounted to at least one connector which extends through the formwork space to one formwork member whereby to fix the cladding member to the formwork member and thereby to the wall assembly.

The connectors may brace each cladding member to the cementitious material and the formwork member and thereby brace adjacent cladding panels to each other through their shared formwork member.

The cladding members arranged in different horizontal rows may be positioned so that the formwork members are vertically aligned with each other up the height of the wall assembly so as to form an interconnected formwork space extending linearly up the height of the wall assembly. Further the cladding members may have two ends and the two ends of the cladding panels in different rows may be vertically aligned with each other.

Each end of each cladding member may have a vertically extending formwork member positioned adjacent thereto.

These vertical formwork members may have hardened cementitious material contained therein, in the finished wall assembly.

Each vertically extending formwork member may have at least one connector extending to one cladding member of two adjacent cladding members and at least one further connector extending to the other cladding member of the two adjacent cladding members. In this way both the cladding members are fixed to the formwork member through their respective connectors and thereby also to the wall assembly and to each other.

The formwork at adjacent ends of two adjacent cladding members may be formed by the two adjacent cladding members and also by a formwork member fixed to one of the adjacent cladding members and another formwork member fixed to the other adjacent cladding member.

The two adjacent cladding members may be oriented so that they extend substantially perpendicularly to each other so as to form a corner in the wall assembly. Further each adjacent cladding member may have a formwork member that is an angle section mounted thereon. The two angle sections and the two adjacent cladding members may be arranged so as to form a vertically extending formwork space.

Instead the formwork at adjacent ends of two adjacent cladding members may be formed by the two adjacent cladding members and by one formwork member fixed to one of the adjacent panels.

The two adjacent cladding members may be arranged so that they extend in a linear fashion to form part of a straight section of the wall assembly.

One cladding member of the two adjacent cladding members may have a formwork member thereon that straddles the adjacent ends of the adjacent cladding members, and at least one connector from each cladding member may pass through the formwork space and be mounted on the same formwork member whereby to brace both cladding members to the same formwork member. This braces both cladding members to the cementitious material in the formwork space of the single formwork member.

The formwork member may be in the form of a channel section, and may have one mounting flange mounted on one adjacent cladding member and one or more connectors mounted on said one adjacent cladding member and said channel section. The other adjacent cladding member may have a connector mounted thereon and on the channel section.

One or more of the formwork members may include a filler body that is spaced from the cladding that comprises a filler material that can be penetrated by a connector to engage the filler material and fix the connector to the formwork member.

The formwork member may be in the form of an elongate channel section having a channel base and the filler body may be positioned against the channel base remote from the cladding. Instead the formwork member may be in the form of an elongate angle section having a take away face and a cross face and the filler body may be positioned against the cross face remote from the cladding, The filler body may have one or more passages formed therein for receiving the connectors therein. The filler body and/or the formwork members may have one or more further passages through which service conduits and service cables and pipes can be passed to provide services on the wall assembly.

The wall assembly may further include an internal wall liner mounted on the formwork members so as to form an internal wall liner spaced away from the cladding.

Where the formwork members are channel sections, the internal wall liner may be mounted on the channel base, e.g. an outside surface thereof. Where the formwork members include angle sections, the internal wall liner may be mounted on the cross face of the angle section, e.g. an outside surface thereof.

The internal wall liner may comprise a non-flexible wall liner, e.g. plasterboard, that is mounted on the formwork members. The wall liner may be mounted by means of fastening elements that are passed through the wall liner into the formwork member and the filler body. Instead the wall liner may be mounted by adhesive onto the formwork members, e.g. an outside surface thereof.

The wall assembly may further include an insulating material that is positioned between the wall liner and the cladding, and the insulating material may be sized and configured to fit in between adjacent formwork members of the wall assembly along the length of the wall assembly. The wall assembly may further include a services space adjacent to the wall liner for receiving service conduits and cables therein. The services space may be longitudinally aligned with the filler body on the formwork members. The formwork members may have pre-drilled openings formed therein for the passage of service cables and conduits therethrough and into the filler body 36.

The wall assembly may include a plurality of wall units and each wall unit may include a cladding and at least one formwork member mounted on the cladding. Further each wall unit may include at least one connector extending between each formwork member and the cladding on which it is mounted. One or more of the formwork members may be in the form of an elongate profile of structural steel having a substantially constant cross sectional shape.

According to another aspect of the present disclosure there is provided a wall assembly comprising:

a cladding and a plurality of formwork members mounted on the cladding, wherein at least one of the formwork members is arranged so that the formwork member/s forms at least part of a formwork defining a formwork space which receives a cementitious material therein and forms an elongate structural member within the constructed wall assembly.

According to another aspect of the present disclosure there is provided a wall assembly for forming an external wall on a building structure, the wall assembly comprising:

a cladding and a plurality of a plurality of substantially vertically extending formwork members that are spaced from each other along the wall assembly, and at least one substantially horizontally extending formwork member extending along the wall assembly, and the formwork members are in the form of elongate profiles having a substantially constant cross sectional shape mounted on the cladding and arranged so that the formwork member/s and the cladding form an interconnected formwork defining an interconnected formwork space, so that cementitious material cast within the formwork space forms a structure within the constructed wall assembly; and a plurality of connectors extending between each vertical and horizontal formwork member and the cladding on which it is mounted, each connector extending from the cladding through the formwork space to the formwork member so that it is enclosed by the cast cementitious material.

The structure may be a single underlying structural frame.

The wall assembly may further include one or more vertical reinforcing bars in the vertical formwork members that are filled with cementitious material to form structural posts, and a horizontal reinforcing bar in the horizontal formwork member that is filled with cementitious material. The vertical and horizontal reinforcing bars may be fixed to the connectors within the respective formwork members.

The formwork members may be elongate profiles having a substantially constant cross sectional shape including one or more channel sections and one or more angle sections, and each formwork member may include a filler body that is spaced from the cladding that can be penetrated by a connector to engage the filler material and fix the connector to the formwork member. The filler body may comprise a filler material.

The wall assembly may include any one or more of the features of the wall assembly defined in the preceding aspect of the present disclosure.

According to another aspect of the present disclosure there is provided a method of constructing a wall assembly, the method including:

placing a cladding and a plurality of formwork members on a wall support, and arranging the formwork members on the cladding such that the formwork members and the cladding form a formwork defining a formwork space; and pouring a flowable cementitious material into the formwork space and allowing it to set whereby to form an elongated structural member of cementitious material within the formwork.

Placing the cladding and the plurality of formwork members on a wall support may include placing pre-assembled wall units of formwork members mounted on cladding members on the wall support.

The method may include bracing and supporting the formwork members and cladding prior to pouring the flowable cementitious material into the formwork space, and then removing the bracing and support after the cementitious material has set.

Bracing and supporting the formwork members and cladding may include providing temporary construction brackets for the formwork members for locating the formwork members in position on the wall support and holding the formwork members in position when the cementitious material is poured into the formwork space. The method may also include removing the temporary construction brackets when the cementitious material has set and the formwork no longer requires support.

The method may further include forming the wall support on a support substrate, e.g. by pouring a concrete slab or footing for the wall assembly, prior to placing the cladding and plurality of formwork members on the wall support.

According to another aspect of the present disclosure there is provided a wall unit for use in building a wall assembly, the wall unit including:

a cladding and at least one formwork member mounted on the cladding, wherein the formwork member is arranged so that the formwork member forms at least part of a formwork defining a formwork space for receiving a settable cementitious material therein during construction of a wall assembly, which cementitious material subsequently sets and forms an elongate structural member within a constructed wall assembly.

The formwork members may be in the form of elongate profiles having a substantially constant cross sectional shape, and the wall unit may further include a plurality of connectors extending from the cladding through the formwork space to the formwork member so that the connector is surrounded by cementitious material when it is cast into the formwork space.

The cladding and the formwork member and the connectors may include any one or more of the features thereof defined in the preceding aspects of the present disclosure.

According to another aspect of the present disclosure there is provided a wall assembly, comprising:

a plurality of wall units, each wall unit including a cladding member and at least one formwork member in the form of an elongate profile mounted on the cladding member by means of a connector extending between each formwork member and the cladding member, wherein the wall units are arranged so that the formwork member and the cladding member form a formwork defining a formwork space which receives a cementitious material therein which forms at least one elongate structural cementitious member within the constructed wall assembly and the connector passes through the formwork space.

The wall units may be arranged in two or more horizontally extending rows, and the wall units in different rows may be arranged so that the formwork members in the different rows are aligned with each other so that they are interconnected with each other.

Further the cladding members in different rows may be arranged so that their opposed ends are aligned with each other.

The wall assembly may include a first row of wall units comprising a plurality of wall units positioned adjacent each other, and a second row of wall units comprising a plurality of wall units mounted on the first row of wall units where the wall units in the second row are substantially aligned with the wall units of the first row.

The wall assembly may further include a vertical locator for locating each wall unit in the first row with its associated wall unit in the second row and aligning the wall units with each other.

The vertical locator may comprise a formation on an upper end of the formwork member of one wall unit that locates a lower end of the formwork member of the wall unit above said one wall unit.

Each wall unit may include a formwork member that is substantially vertically extending for receiving a settable cementitious material therein to form a support post. One or more wall units may include a formwork member that is substantially horizontally extending and which contains a set cementitious material for receiving a settable cementitious material therein to form a horizontal support beam.

The wall units may include any one or more of the features of the wall units defined in the preceding aspect of the present disclosure.

According to another aspect of the present disclosure there is provided a method of constructing a wall assembly from a plurality of wall units, the method including:

providing a wall support and a plurality of wall units, each wall unit including a cladding and at least one formwork member for forming a formwork for receiving a settable cementitious material therein, laying the wall units on the wall support so as to form one or more rows of wall units, and arranging the cladding and the formwork members form a formwork defining a formwork space; and pouring a cementitious material into the formwork space; and allowing it to set whereby to form one or more structural cementitious members within the formwork.

The formwork is not temporary and forms a permanent feature of the wall assembly.

The method may further include forming the wall support on a support substrate prior to mounting the wall units on the wall support.

Each wall unit may include a connector that extends from the cladding to the formwork member and passes through the formwork space, and pouring a cementitious material into the formwork may include surrounding the connector with the cementitious material to anchor the connector in the cementitious material.

Laying the wall units on the wall support may comprise laying a plurality of rows of wall units and aligning the formwork members of vertically adjacent rows with each other so as to form continuous formwork and formwork space.

Aligning the formwork members of vertically adjacent rows may include using a vertical locator on a formwork member in the first row with its associate wall unit in the second row.

Arranging the cladding and the formwork members to form a formwork may include arranging some formwork members in a vertically extending orientation for forming one or more vertically extending support posts.

The method may further include positioning a vertically extending reinforcing bar in the formwork and fixing a lower end of the reinforcing bar in the wall support and fixing the reinforcing bar to one or more connectors within the formwork space whereby to brace the wall assembly.

Arranging the cladding and the formwork members may include arranging some formwork members in a horizontally extending orientation for forming a horizontally extending support beam on the wall assembly.

Further arranging some formwork members in a horizontally extending orientation may include arranging the horizontally extending formwork members towards an upper end of the cladding so that it forms a horizontal support beam extending along an upper end of the wall.

According to another aspect of the present disclosure there is provided a building structure including:

a building support on the ground;

a wall assembly as defined in any one of the preceding aspects of the present disclosure to form an external wall of a single storey of a building; and a roof mounted on the wall assembly.

The building structure may be a single storey building.

Instead the building may be a multi-storey building and the wall assembly defined in any of the preceding aspects of the present disclosure is used to form the external wall of each storey of the building. The building structure may further include intermediate floor structures in between each of the floors of the building.

BRIEF DESCRIPTION OF THE DRAWINGS

A wall assembly and a method for making a wall assembly, as well as a building structure including the wall assembly, in accordance with theme present disclosure may manifest itself in a variety of forms. It will be convenient to hereinafter describe several embodiments in detail with reference to the accompanying drawings. The purpose of providing this detailed description is to instruct persons having an interest in the subject matter of the invention how to carry the invention into practical effect. However it is to be clearly understood that the specific nature of this detailed description does not supersede the generality of the preceding broad description. In the drawings.

DETAILED DESCRIPTION OF EXAMPLE EMBODIMENTS

Figure 1:
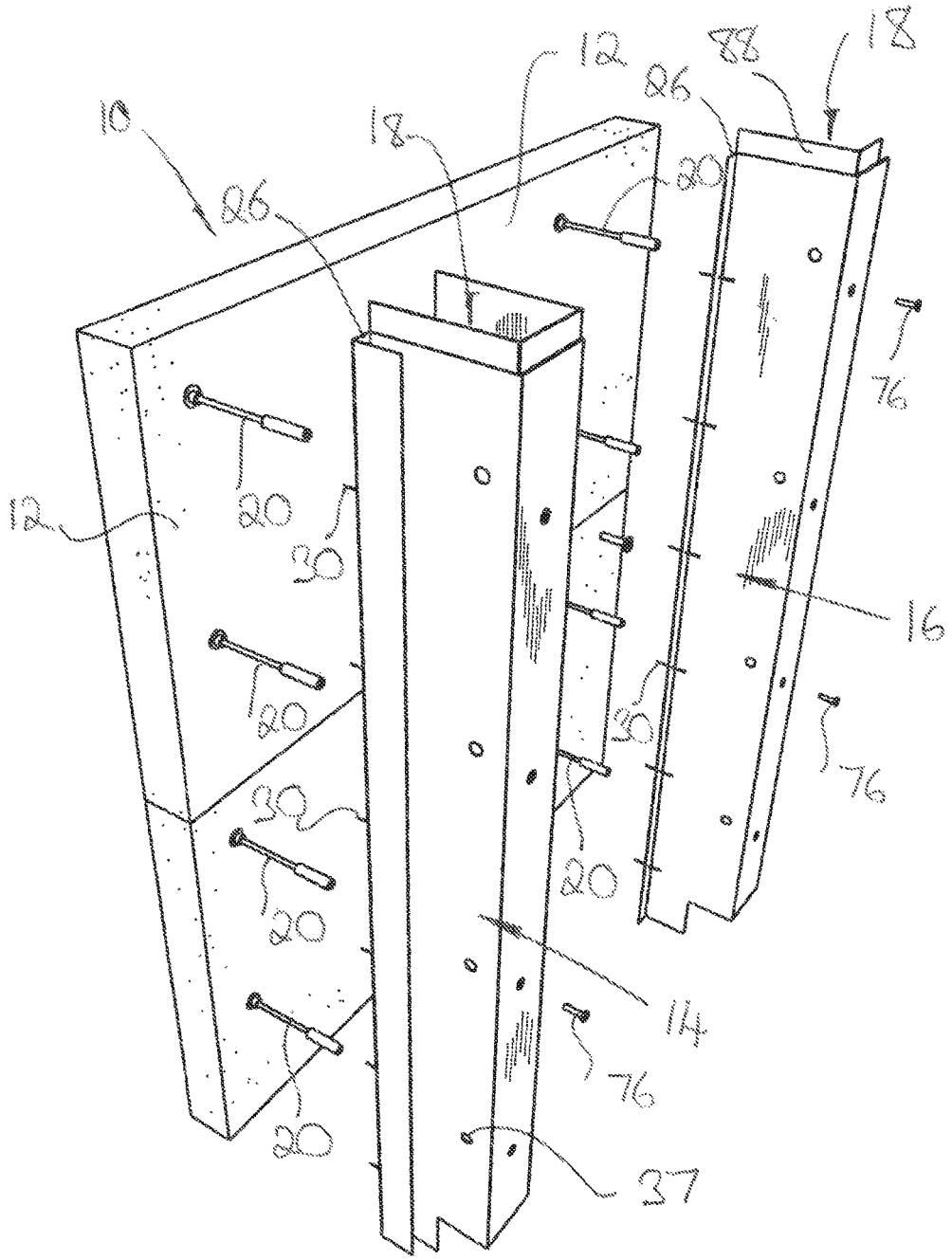
FIG. 1 is an exploded three dimensional view of a lower wall unit for a wall assembly.

In FIG. 1 reference numeral 10 refers generally to a basic wall unit used in a wall assembly in accordance with one embodiment in accordance with the present disclosure. The wall unit 10 is suitable for use on a lower row of wall units on the wall assembly. It is not intended for use on an upper row of wall units where the wall is required to support a load bearing structure such as a roof.

The wall unit 10 comprises broadly a cladding 12 and two formwork members 14 and 16 that are mounted on the cladding 12. The formwork members 14 and 16 each define a formwork space 18 within which a cementitious material is received to form a cementitious structural member within a finished or constructed wall assembly. The wall unit 10 further includes a plurality of connectors 20 extending between the formwork members 14 and 16 and the cladding 12. Each connector 20 is elongate and has two opposed ends 22 and 24. One end 22 is fixed to the cladding 12 and the other end 24 is fixed to the formwork member 14 or 16. The connectors 20 are spaced apart from each other in a row along the length of the formwork members 14 and 16.

The formwork members 14 and 16 are in the form of elongate engineering profiles having a substantially constant cross sectional shape. In the drawings, the member 14 is a profile that is a channel section, e.g. of structural steel, (hereinafter a channel member). The member 16 by contrast is a profile that is an angle section of structural steel (hereinafter an angle member). The formwork members 14 and 16 have longitudinal sides extending the length thereof and mounting flanges 26 and 28 extending along each longitudinal side for the length of the member 14 and 16. These mounting flanges 26 and 28 are used to mount the formwork member 14 or 16 to the cladding 12 member by passing fastening elements 30 through the mounting flanges 26 and 28 and into a body of the cladding 12. The fastening elements 30 are located at spaced intervals along the length of the mounting flanges 26 and 28 as shown in the drawings. Conveniently the fastening elements are in the form of screws although clearly other fastening elements such as nails and tacks and rivets could also conceivably be used. The wall unit is pre-manufactured prior to its use in construction of a wall assembly and the fastening elements help to hold the formwork member mounted to the cladding for handling and transport.

The cladding 12 comprises a plurality of cladding members each of which comprise panels of aerated concrete material and is about 75 mm wide. In the illustrated embodiment two cladding members are mounted on top of each other. One example of an aerated concrete panel suitable for use is sandwich panel of light weight construction. Another example of an aerated concrete panel suitable for use is the HEBEL™ panels made by CSR Ltd in Sydney.

The channel member 14 includes a channel base 38 and a filler body 36 that is received within the base 38 of the channel member 14 remote from the cladding members 12. The filler body 36 comprises a filler material that can be penetrated by a connector 20 to engage the filler material and fix the connector 20 to the formwork member 14. Correspondingly the angle member 16 has a take away face 39 and a cross face 40. The angle member 16 similarly includes a filler body 38 against the cross face 40 that is remote from the cladding members 12. In addition to receiving the connectors 20 therein to fix the connectors 20 to the formwork members 14 and 16 the filler body 36 also performs a number of other functions. For example the filler body 36 can have conduit passages 35 formed therein which can receive cables and conduits therethrough to assist in passing services along the wall to where they are required. In one example holes for receiving service conduits are drilled in the formwork members 14, 16 when the wall unit is pre-manufactured. A tradesman can then drill out a passage in the filler body 36 when a passage is required to receive a service conduit or cable therethrough.

The end 22 of each connector 20 is mounted to the cladding member 12 by means of a screw threaded shank having a nut with an enlarged head or retainer 42 which resembles a washer, and which provides a large bearing surface. The enlarged head or retainer 42 bears up against an outer surface of the cladding member, e.g. on a side thereof that is remote from the formwork member 14. In the illustrated embodiment the nut and enlarged head or retainer 42 is received within a shallow recess within the outer surface of the cladding member 12. This feature ensures that the nut and retainer 42 do not project proud of the outer surface so as to thereby interrupt a smooth coating or rendering of the surface of the cladding member 12.

The other end 24 of each connector 20 is received within the fixing body 36 and defines a screw threaded bore 43 that is accessible from an outside of the channel formwork member 14. This enables a screw or retainer to be screwed onto the other end 24 of the connector 20. The drawings illustrate small screws 76 which are screwed into the bores 43 on the opposite ends 24 of some of the connectors 20 to hold the wall units 10 together for manufacture and transport and then also for the construction of the wall assembly.

FIGS. 4 to 8 illustrate a wall unit 11 that is suitable for use on an upper row of a wall assembly that is intended to support a load. The wall unit 11 has two vertically extending formwork members 14 and 16 that are constructed like the formwork members 14 and 16 in the preceding drawings. As the wall unit 11 has many similarities to the wall unit 10 shown in the earlier drawings the same reference numerals will be used to refer to the same components unless otherwise illustrated. The following description will focus on the differences between this wall unit and the wall unit illustrated in the preceding drawings.

This upper row wall unit 11 has additional features including a horizontally extending formwork member 50 that enables a horizontally extending structural cementitious member, such as a beam, to be formed along an upper edge of a wall assembly. The horizontally extending formwork member 50 is very similar to the vertically extending angle member 16 described in the previous drawings with the exception that it is orientated transverse to the vertical formwork members 14 and 16.

The horizontally extending formwork member 50 is in the form of an angle member. The take away face 39 extends away from the cladding member 12 with a horizontal orientation. The take away face 39 has a mounting flange 52 running along the longitudinal side thereof which is fixed to the cladding member 12 by fastening elements that are typically screws, at spaced intervals along the length thereof. The cross face 40 of the angle member extends up from a remote end of the take away face 39 with a vertical orientation. The filler body 36 lies up against the cross face 40.

The cladding 12 of the wall unit 11 has a timber or steel roof support member 54 running along an upper edge of an uppermost cladding member. This support member 54 is engineered so that it is suitable for supporting a structure such as a roof member thereon. FIGS. 4 to 7 show connectors 56 extending in a substantially horizontal direction through the formwork space from one end which is fixed to the cladding member 12 to the other end which is fixed to the timber or steel roof support member 54.

On a consideration of these drawings it will be appreciated that the horizontally extending formwork member 50 is constructed in substantially the same way as the vertically extending formwork members 14 and 16. Further it functions in a very similar way to the formwork members 14 and 16 to form part of a formwork for receiving cementitious material. In this wall unit 11 the formwork member 50, together with the timber or steel roof support member 54 from the cladding, forms a formwork defining a formwork space for casting a horizontally extending structural member such as a beam. The connectors 56 extend from the cross face 40 of the formwork member 50 through the formwork space to the roof support member 54 in analogous fashion to the connectors 20. These connectors 56 in addition to have a tensioning capability also having a spacing feature that holds the roof support member 54 and the cross face 40 of the formwork member 50 upright when the connectors 56 are tightened. Typically this might involve a spacing sleeve which holds the support member 54 and cross face 40 the desired distance apart from each other when the connectors 56 are tightened.

The wall units are typically pre-manufactured in a factory and then transported to a building site. The example wall units 10, 11 illustrated in these drawings are sized so that they can be manually handled and put in position on a wall support by 1 or 2 workers. The wall units 10, 11 do not require a lifting device to lift them up on side and place them in position on the support.

Figure 8:
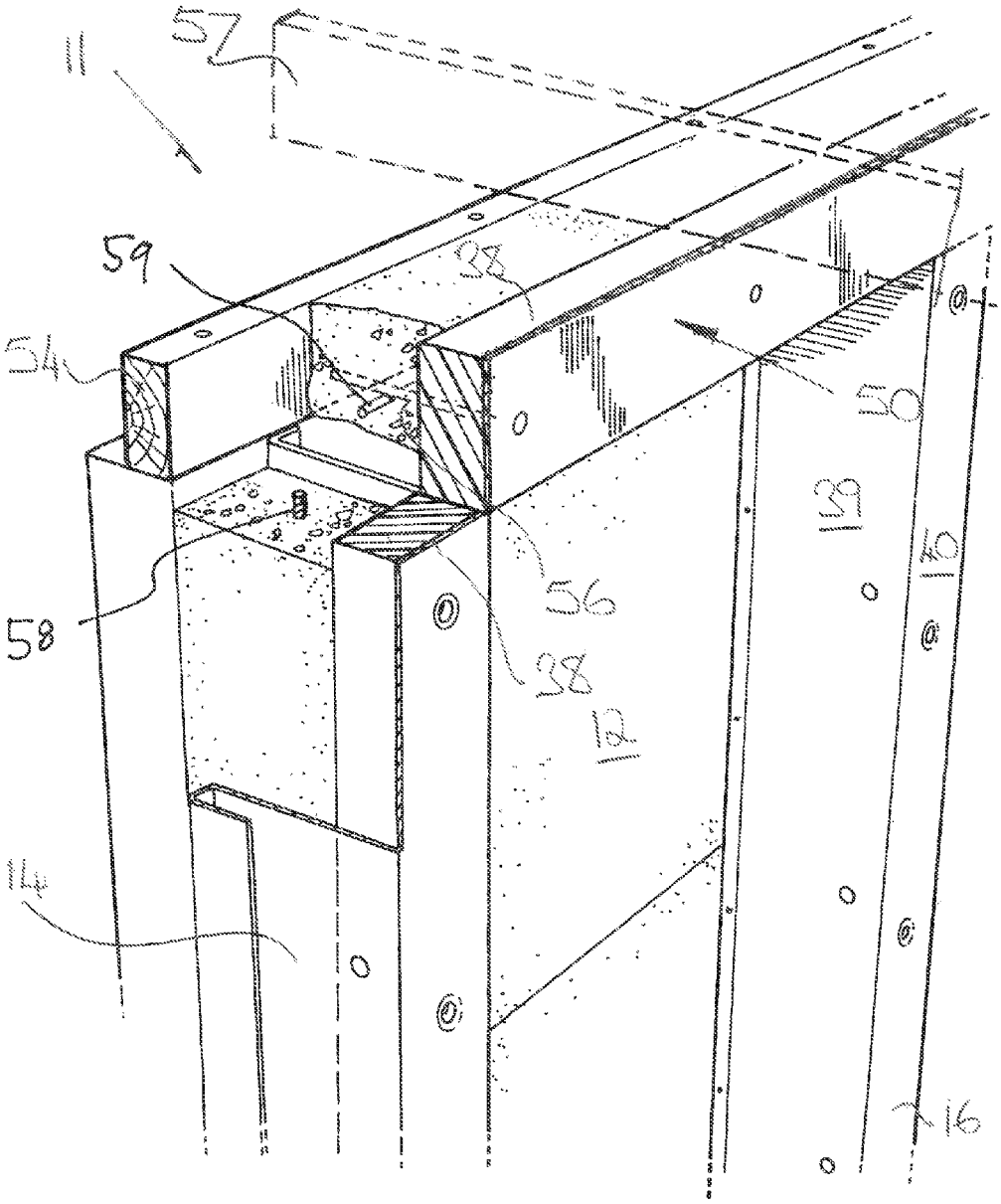
FIG. 8 is a three dimensional view of part of a wall assembly including the upper wall unit of FIG. 5 showing a cementitious structural member and a rafter mounted thereon.

FIG. 8 is a perspective view showing an upper part of a wall assembly including the upper wall unit after it has been constructed. In FIG. 8 a vertically extending structural member such as a support post has been cast in each of the formwork members 14 and 16. As shown in the drawings, the connectors 20 are surrounded by cementitious material and are received in the cementitious material.

The vertically extending reinforcing bars 58 are received in each of the formwork members 14, 16 to reinforce the support posts. When the cementitious material is cast inside the formwork space 18 the vertical reinforcing bar 58 is enclosed in concrete. Each of the vertical reinforcing bars 58 is fixed to the horizontally extending connectors passing from the cladding members to the vertical formwork arrangement at intervals up the height of the formwork members 14, 16. The vertical reinforcing bars 58 are anchored in a wall support (not shown) on which the wall is built. This considerably enhances the strength of the wall assembly by bracing the components of the wall securely to the wall support.

Further as shown in FIG. 8 a horizontally extending reinforcing bar 59 is received within the horizontal formwork space defined by the horizontal formwork member 50. This horizontal reinforcing bar 59 in turn can be fixed to each of the connectors 56 that are passed through the horizontal formwork space 51. It can also be fixed to the vertical reinforcing bars 58 in the vertical formwork spaces 18, e.g. towards upper ends thereof.

As shown the horizontally extending support beam is cast from a cementitious material extending along the upper edge of the wall assembly. The cast beam and the roof support member 40 are designed to support a roof truss and a roof thereon. In particular FIG. 8 shows part of a roof rafter 57 mounted on both the roof support member 54 and the support beam. The roof truss can be mounted directly on the roof support member 44 and the concrete beam. The rafter is tied to the roof support beam in a way that is known in the art and this this will not be described in further detail in this specification.

Figure 9:
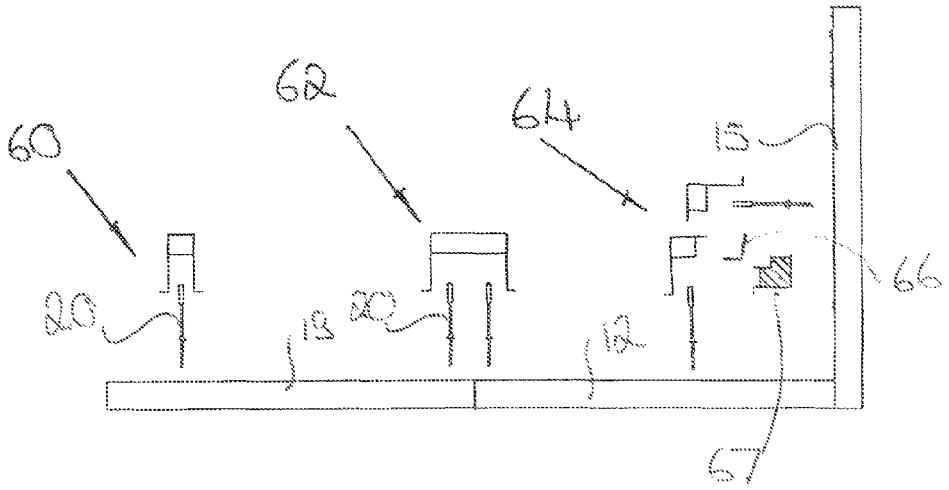
FIG. 9 is an exploded top plan view of three adjacent wall units showing how they are connected to the wall assembly.
Figure 10:
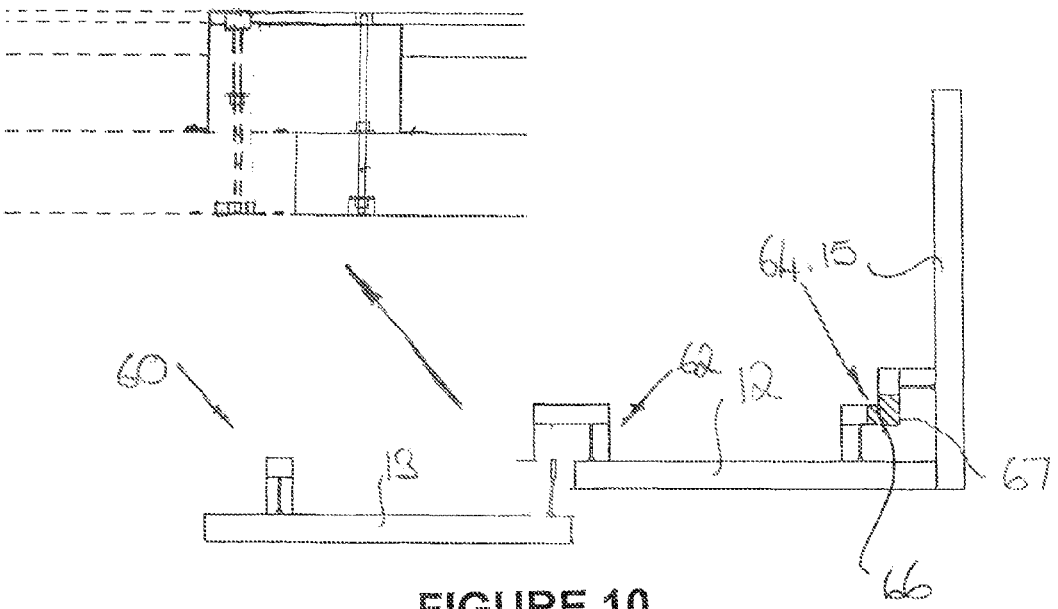
FIG. 10 is an exploded top plan view of three adjacent wall units of FIG. 9.

FIGS. 9 and 10 are simple schematic illustrations that show how different vertically extending formwork members can be mounted on the cladding members. It also shows how they can be used to achieve different purposes in the wall assembly. Unless otherwise indicated the same reference numerals will be used to refer to the same components as in the earlier drawings.

In FIGS. 9 and 10 the formwork member indicated by reference numeral 60 is a simple channel member with mounting flanges extending along each longitudinal side thereof. It has a relatively thin or narrow extent and each side of the channel member 60 is mounted to the same cladding member 12. That is it is used to provide additional support and strength intermediate the ends of a cladding member 12. It is not used to link or brace two adjacent cladding members 12 to each other.

In FIGS. 9 and 10 a channel member indicated by reference numeral 62 is used to brace or link two adjacent overlapping cladding members 12 and 13 that extend in a line or in a linear fashion along the wall assembly to each other and to the general wall assembly. The channel member 62 has a considerably wider or broader extent than the channel member 60 and has mounting flanges 26 and 28 running along the longitudinal sides thereof. One mounting flange 26 is mounted to the cladding member 12 and the other flange 28 is free and projects out beyond the end of the cladding panel 12. A series of connectors 20 extend from the first cladding member 12 to the formwork member 62 towards one side of the formwork member 62. The other cladding member 13 has a corresponding series of connectors 20 projecting out therefrom having free outer ends. When the cladding panels 12 and 13 are placed in their position during construction of the wall, the connectors 20 from the second panel 13 are inserted into corresponding connector openings defined in the formwork member 62.

In FIGS. 9 and 10 the third formwork member 64 is used when two wall units 12 and 15 are arranged perpendicular to each other to enable the wall assembly to undergo a ninety degree turn. Each formwork member 16 is in the form of an angle section and there are angle sections mounted on each of the proximate ends of the adjacent cladding members 12 and 15. The angle sections of the two formwork members 16 lie adjacent each other at right angles to each other so as to form a vertical structural member that is a corner post in the wall. A connector 66 which itself is in the form of an angle profile is used to link or bridge across adjacent ends of the cross faces of the angle sections 64 as shown in the drawings. A blank body 67, e.g. of polystyrene, sits against the connector 66.

Figure 11:
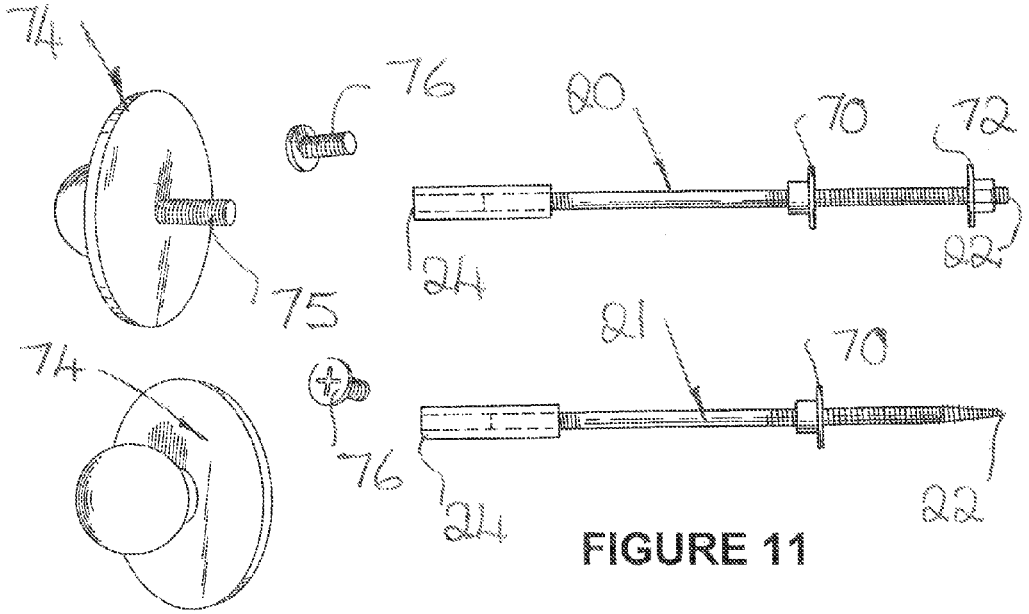
FIG. 11 is a schematic perspective view showing a connector retainer and a screw for use with connectors.

FIG. 11 illustrates two example connectors that can be used in the wall assembly. One connector is indicated by the reference numeral 20 and the other connector is indicated by the reference numeral 21. The connector 20 has a spacer 70 towards its end 22 for bearing against an inner surface of the cladding member 12 and a nut and an enlarged retaining formation 72 for bearing against an outer surface of the cladding member 12. The connector 20 is suitable for use where the material of the cladding member is not very strong. For example this connector 20 is used when aerated cementitious panels are used for the cladding members 12.

By contrast the second connector 21 has a sharp tip for penetrating the material of the cladding member and engaging the material. This connector 21 is suitable for being used when the cladding member 12 is timber. With timber cladding a screw formation on a tip of the connector 21 can engage the cladding member 12 with sufficient bite and grip that a separate nut and enlarged retaining formation is not required.

FIG. 11 also illustrates a connector retainer that is indicated by reference numeral 74. The connector 20 has a screw threaded bore 43 towards the end 24 thereof which interacts with the connector retainer 74 during construction of the wall. The connector retainer 74 comprises basically a knob-like handle and screw threaded shank 75 extending away from the handle. The shank 75 is sized to be received within the screw threaded bore 43 defined in the end 24 of the connector 20. During pouring of the cementitious material the members 14 and 16 are subjected to an outward pressure due to the specific gravity of the poured cementitious material which is significantly greater than water. The connector retainer 74 is used to hold the formwork member 14 or 16 firmly and securely in position when the cementitious material is poured into the formwork member 14 or 16. Once the cementitious material has set and it no longer applies an outward force to the formwork members 14 and 16 the connector retainers 74 can be removed.

FIG. 11 also illustrates a screw which is indicated by reference numeral 76. The screw 76 is also sized so that it can be screwed into the bore 43 formed in the side 24 of the connector 20. Typically these screws 76 are screwed into position on at least some of the connectors 20 when the wall unit 10 is pre-manufactured. These screws 76 thus hold the connectors 20 in position on the wall unit 10, 11 while it is being manufactured and also during subsequent handling and transport to a building site. They also help to hold the wall unit 10, 11 together with the fastening elements that are passed through the mounting flanges into the cladding. On a building site the screws 76 hold the connectors in position and the wall units together while the wall units 10 are placed in position on the wall support. Prior to pouring the cementitious material, the connector retainers 74 are mounted on some of the ends 24 of selected connectors 20 (e.g. in place of the screws 76 which are omitted during manufacture or removed on the building site) to brace and support the wall units 10 for the pouring of cementitious material. Once the cementitious material has effectively set around and enclosed the connectors 20 in the structural member that is a post or beam, the different components are effectively braced and connected to each other. The connector retainers 74 are then no longer required and can be removed.

One factor to note is that the nut and retainer 72 on the outer side of the cladding member 12 is positioned so that it is received in a recess below the outer surface of the cladding member 12. This enables a smooth surface to be provided for a render finish or other surface finish to be applied to the outer surface without any unsightly projections disrupting the surface. Further the other end 24 of the connector 20 is also received below the surface of the channel base or cross face of the formwork member 14 or 16. Once again this enables an inner wall liner such as plasterboard to be applied to a surface of the formwork members 14 and 16 without any projections sticking out therefrom. That way the plasterboard can be adhered or fixed to the full base 38 of the channel member 16 or cross face 40 of the angle member in such a way that it lies flat and does not have any projections.

Figure 12:
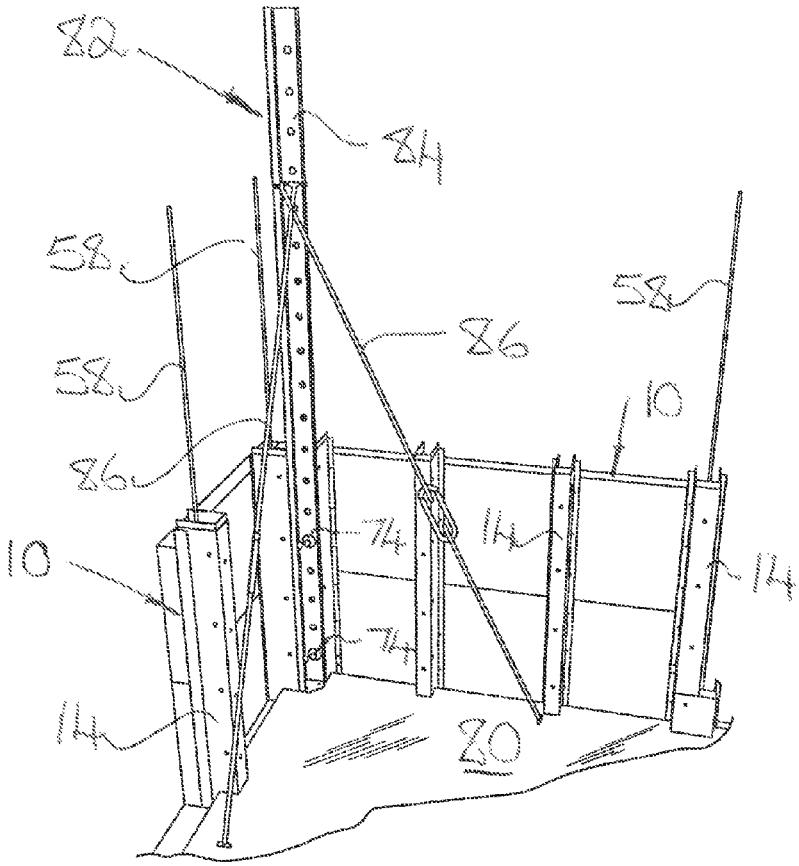
FIG. 12 is a front perspective view showing two adjacent lower wall units mounted in position on a wall support that is a concrete slab.
Figure 13:
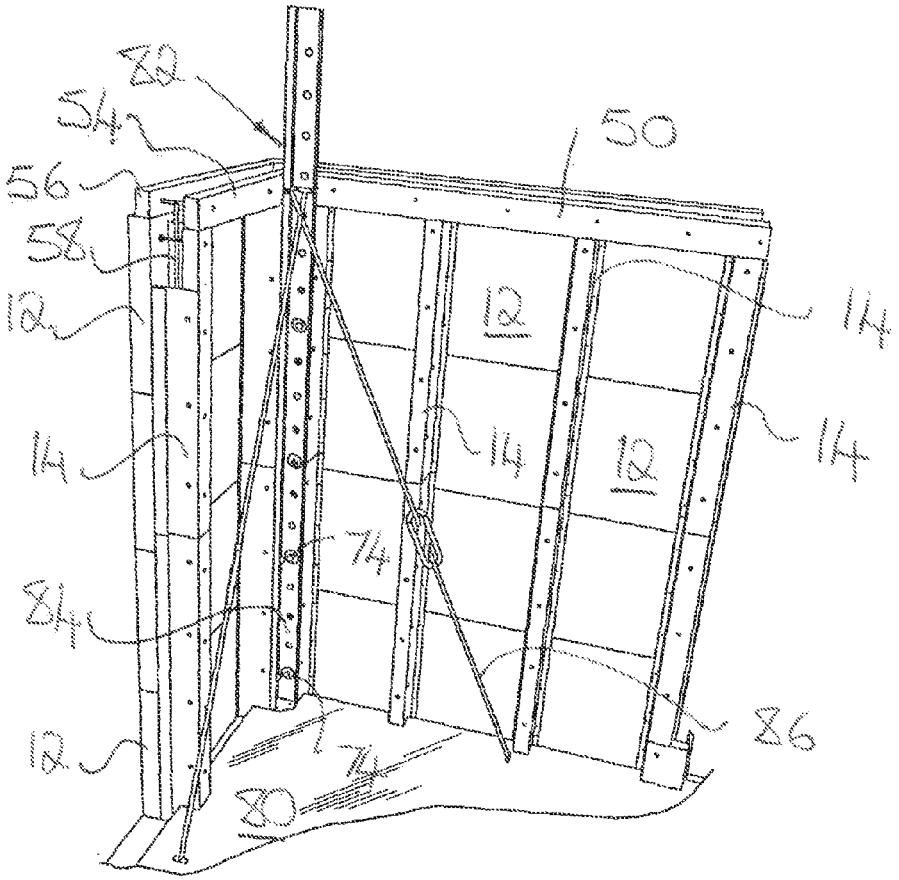
FIG. 13 is a front perspective view of a part of a wall assembly showing two adjacent lower wall units mounted in position on the wall support and two upper wall units mounted on the lower wall units forming a wall assembly.
Figure 14:
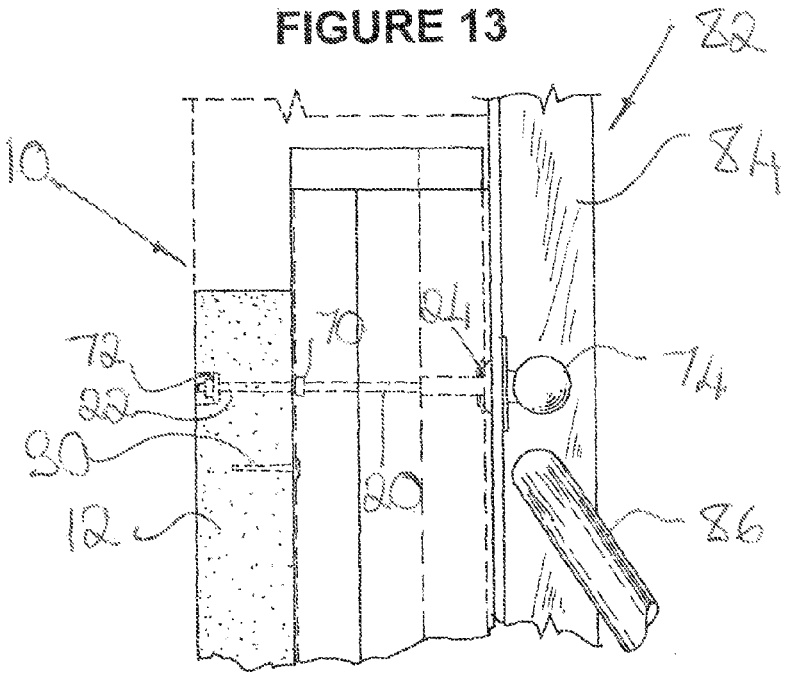
FIG. 14 is a schematic drawing showing how the connectors, formwork members and cladding members of the wall assembly are braced for the pouring of cementitious material.

In use, a section of wall assembly is progressively built up from wall units in the manner shown in the sequence of schematic drawings comprising FIGS. 12 to 14. A wall support that is a concrete slab 80 is first formed on a support surface such as the ground. The concrete slab 80 is shuttered and poured according to known techniques and accordingly will not be described in further detail in this description.

A series of temporary construction brackets 82 are then mounted in position on the slab 80 for locating and supporting the wall units 10, 11 in position on the concrete slab 80. Each temporary construction bracket 82 has a base that is mounted on the slab and a vertically extending member 84 extending upward therefrom. The vertically extending member 84 is stabilised in position by means of one or more stays 86 which extends diagonally from the slab 80 up to the vertically extending member 84. The vertically extending member 84 has mounting formations, e.g. in the form of openings formed therein, for receiving the connector retainer 82 and other fastening elements there through.

Figure 2:
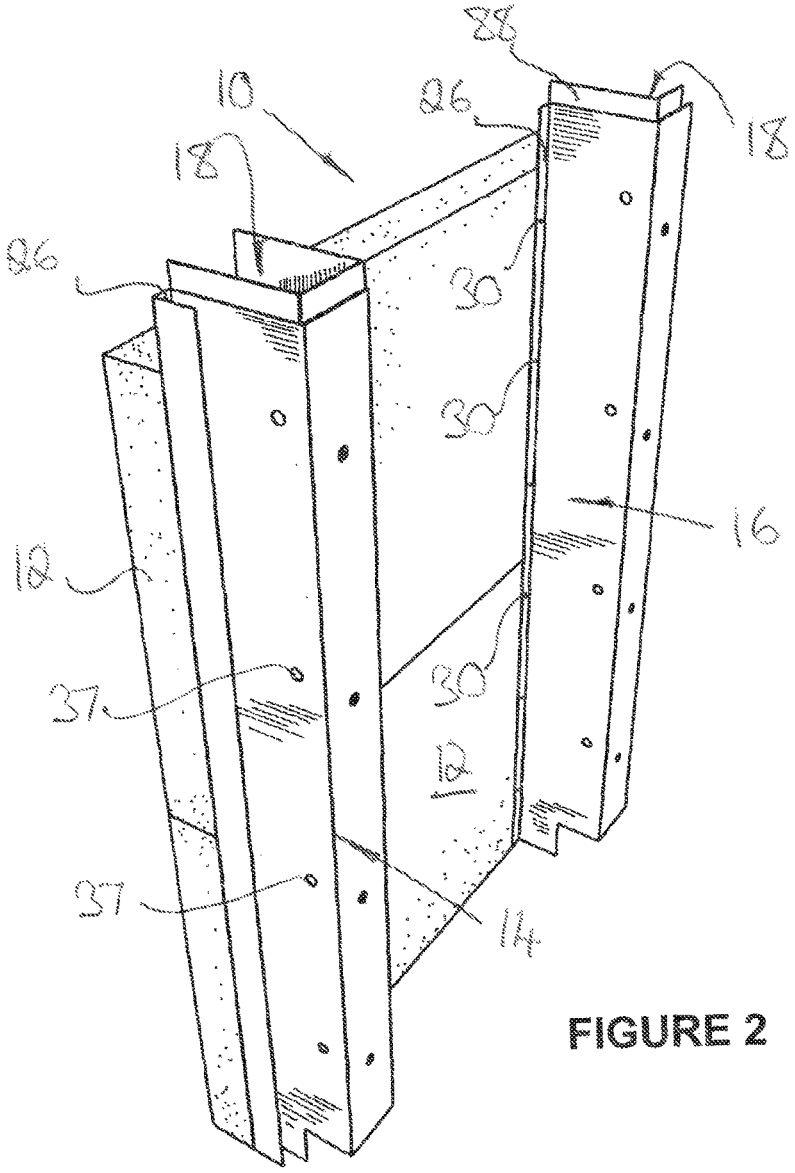
FIG. 2 is three dimensional view of the lower wall unit in FIG. 1 when assembled.
Figure 3:
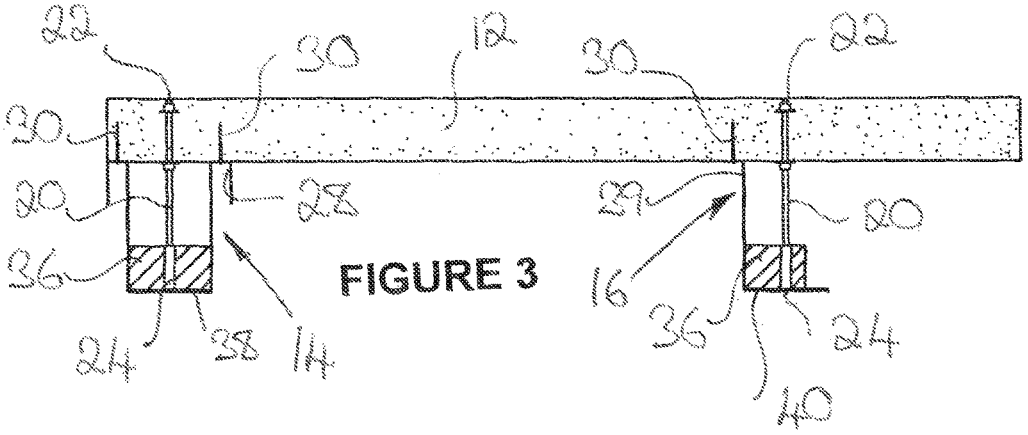
FIG. 3 is a top plan view of the lower wall unit in FIG. 1.
Figure 4:
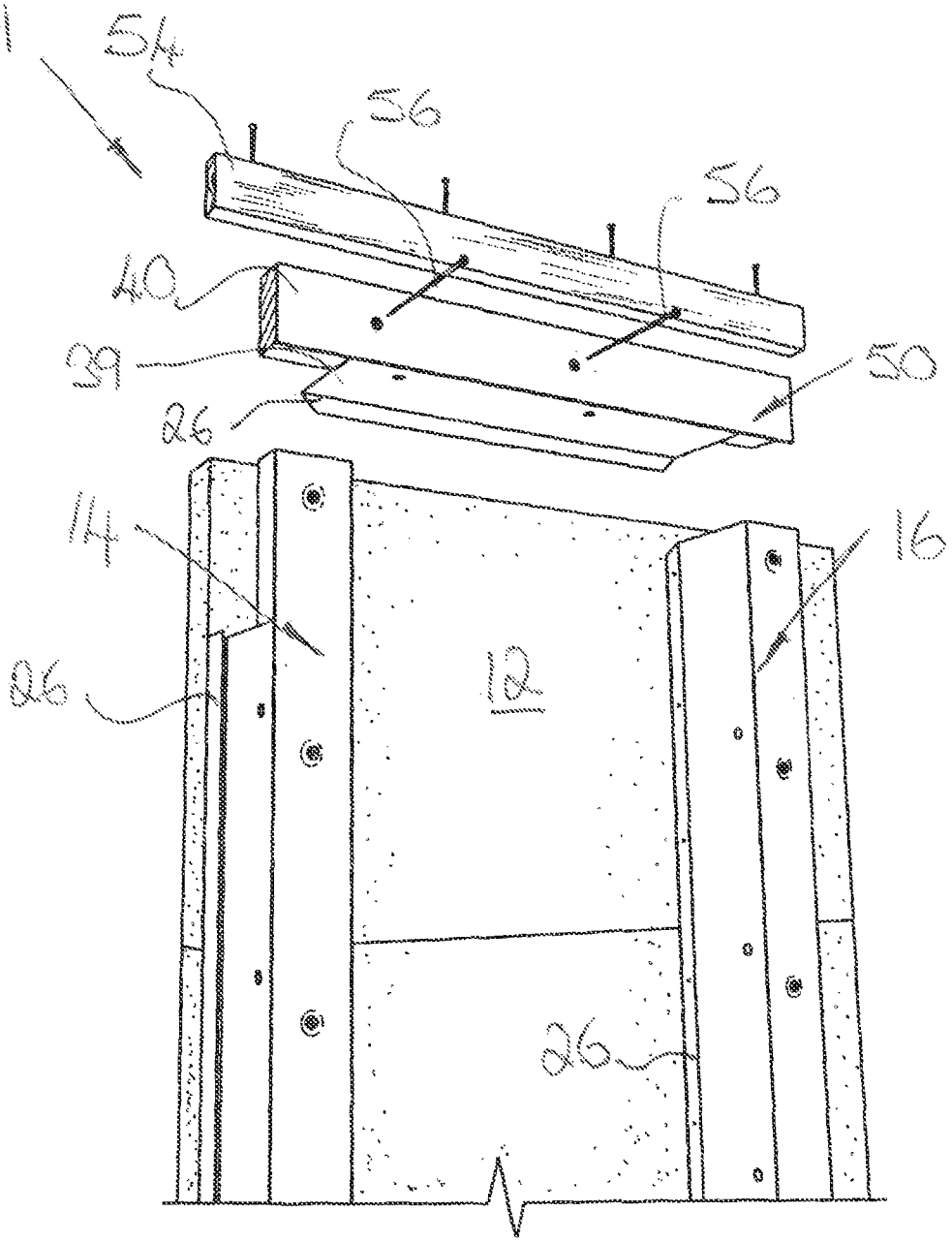
FIG. 4 is a lower exploded three dimensional view of an upper wall unit for a wall assembly.
Figure 5:
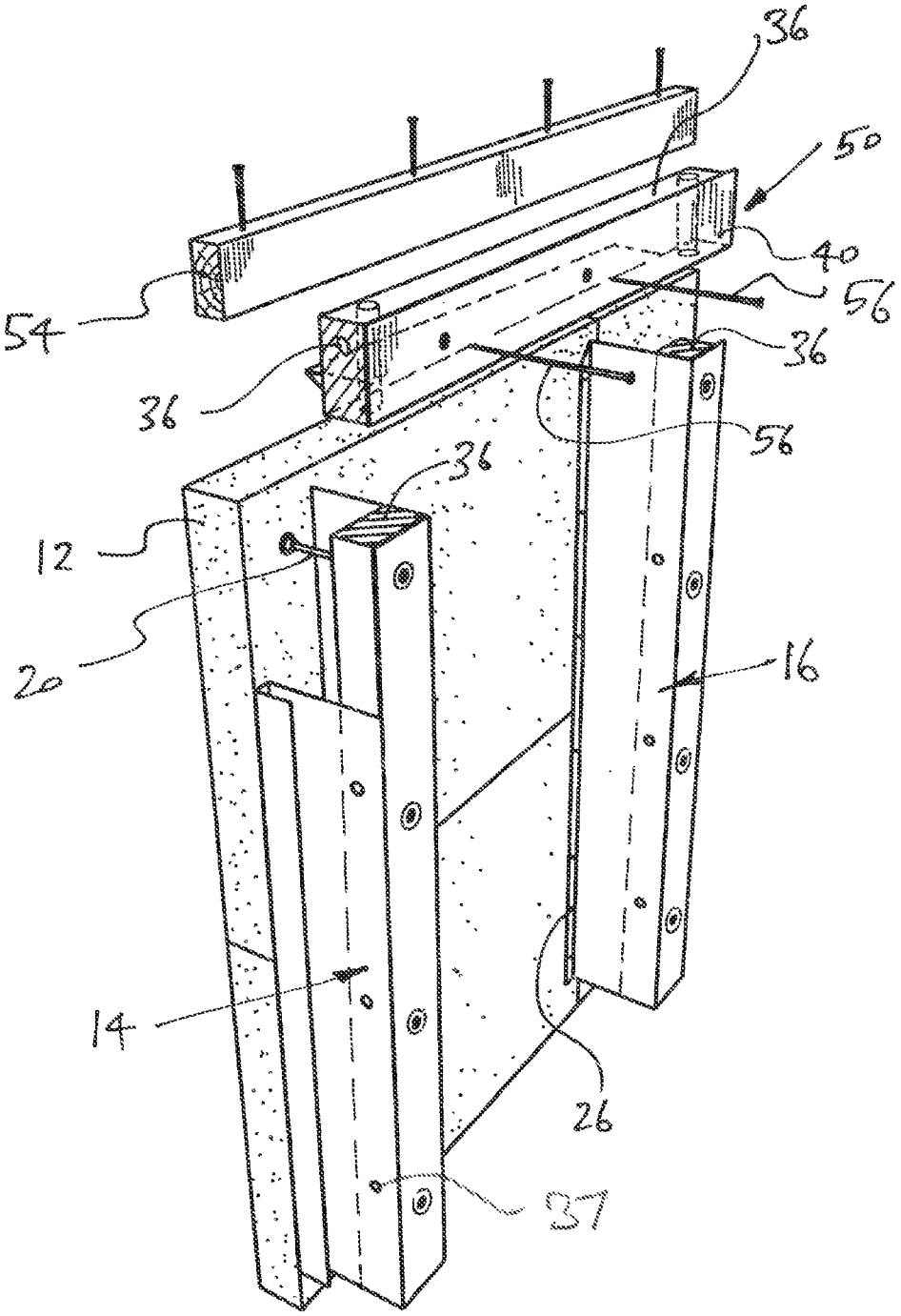
FIG. 5 is an upper exploded three dimensional view of the upper wall unit in FIG. 4.
Figure 6:
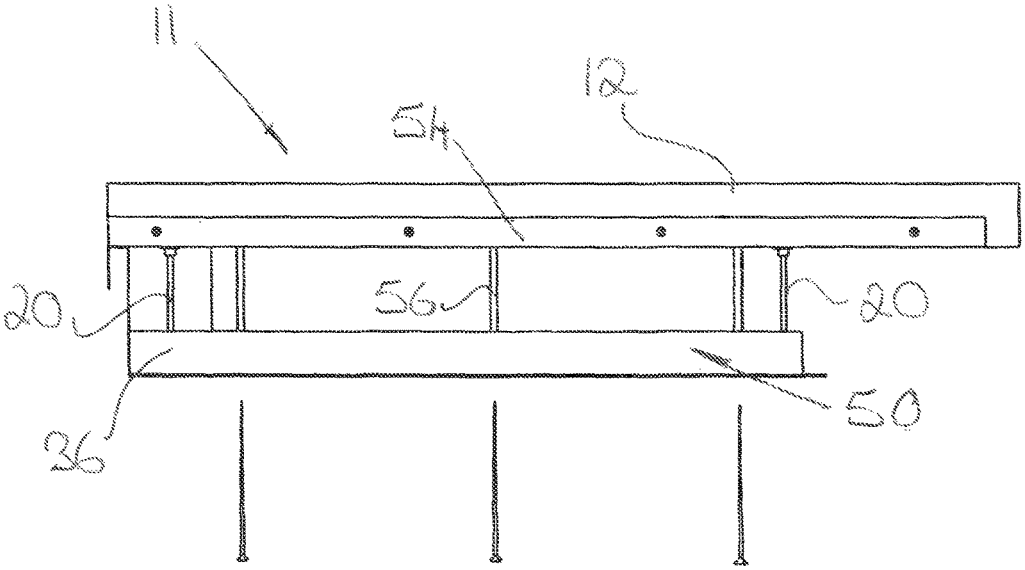
FIG. 6 is an exploded top plan view of the upper wall unit in FIG. 5.
Figure 7:
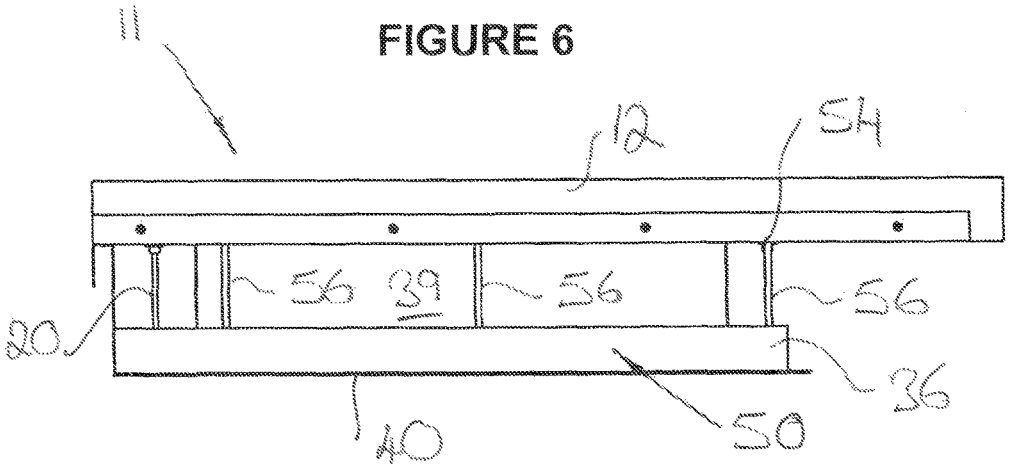
FIG. 7 is a top plan view of the upper wall unit in FIG. 5 when assembled.

Further as shown in the drawing several vertically extending reinforcing rods 58, described above with reference to FIG. 8, are anchored in the slab 80 in positions corresponding to the positions of the vertically extending structural posts. The wall units 10 are then placed in position on the slab 80. A first row of lower wall units 10 as illustrated in FIGS. 1 to 3 is placed on position on the slab 80 as shown in FIG. 12. Certain of the vertically extending formwork members 14, 16 have the vertical reinforcing rods received therein. However other formations 14, 16 on the wall units 10 are blank (i.e. they are not filled with cementitious material to form support posts). Consequently these blank members 14, 16 do not have vertical reinforcing rods therein. It will be appreciated that the number of formwork members that are required to form support posts in a particular wall is a matter of engineering design and will vary from one wall to the next. For a stronger design in a different application, the wall can be designed so that more of the support posts are filled with cementitious material.

The connector retainers 74 are mounted on the temporary construction brackets 82. The shank 75 of the retainer 74 is passed through an opening in the vertical member 84 thereof and screwed into the bore 43 in the opposite end 24 of the connector 20. This locates and mounts the wall unit 10 in position on the slab 80 and braces it sufficiently for the formwork members to receive a pour of cementitious material.

FIG. 13 shows further wall units 10 and 11 mounted on the concrete slab 80. Two upper level wall units 11 of the type illustrated in FIGS. 4 to 7 have been mounted on the lower wall units 10 shown in the preceding drawings. As shown in the drawings the formwork members 14, 16 of the wall units 10, 11 that are vertically adjacent each other are aligned with each other and interconnect with each other. To do this the formwork members 14, 16 on the lower wall units 10 have locating formations 88 that project up therefrom and interact with the formwork members 14, 16 on the upper row of wall units 11. Further the cladding members 10, 11 in the upper and lower rows are of the same length and the ends of the cladding members are aligned with each other.

The upper row of building units 11 including the formwork member 50 forms a horizontally extending formwork running along an upper edge of the wall units 11 for forming a cementitious structural member that is a beam.

An outside of the formwork is formed by the cladding 12, and more specifically the roof support member 54 thereof, as described above in FIGS. 4 to 7. A bottom of the formwork is formed by a cross face 40 of the angle member 50 and an inner side of the formwork is formed by the filler body 36 and the take away face 39 of the angle member 16. There are a plurality of connectors 56 extending from the cross face of the formwork member 50 to the roof support member 54 at spaced intervals along the length of the formwork member 50. These connectors 56 are designed to preserve the spacing of the cross face and the roof support member 54 when the connectors 56 are tensioned.

FIG. 14 is a cross sectional view showing in some detail how the connector retainers 74 are used together with the temporary construction brackets 82 on the wall units 10, 11 to create a structure within which a cementitious material can be safely poured. In particular FIG. 14 shows in detail how the connectors 20 are fixed to the temporary construction brackets 82 and the connector retainers 74. The shank 75 of the connector retainer 74 is passed through an opening in the vertical support 84 of the construction bracket 82 and is then screwed into the screw threaded bore 43 on the end 24 of the connector 20. The bore 35 of the connector 20 is received within the filler body 36 of the member 14 or 16 but does not enter into the formwork space 18. Correspondingly the shank 75 of the connector retainer 74 which is received in the bore 35 is positioned within the filler body 36 and not the formwork space 18. The drawing also shows how fastening elements that are screws 76 described above and illustrated in FIG. 11 are passed through the mounting flanges 22 and 24 and into the cladding member 12 to fix the formwork member 14, 16 to the cladding member 12.

FIG. 14 also shows how the end 22 of the connector 22 is fixed to the cladding member 12. In particular it shows how the enlarged head and retainer 42 bears against an outer surface of the cladding member 12 as described above with reference to FIG. 11.

Figure 15:
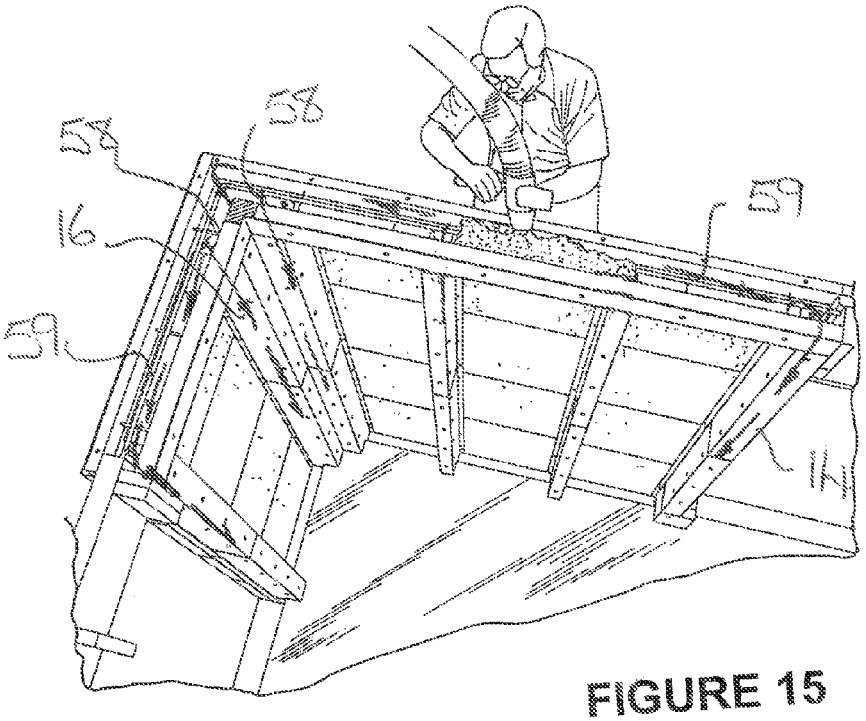
FIG. 15 is a perspective view from above of a flowable cementitious material being poured into the formwork.

FIG. 15 shows a worker pouring cementitious material, e.g. flowable concrete into the formwork assembly. In FIG. 15 the temporary construction brackets 82 and the connector retainers 74 have been omitted from this drawing for clarity. However it will be readily understood that these brackets 82 and retainers 74 are mounted in position to provide crucial support when the concrete is poured into the formwork spaces as described above.

The flowable cementitious material is poured into the horizontal formwork member 50 and flows along the horizontal formwork member 50 and down into the vertical formwork spaces formed by the vertical formwork members 14, 16. This way the vertical extending concrete support posts and the horizontally extending beam are integrally formed such that they are interconnected which enhances structural strength.

Figure 16:
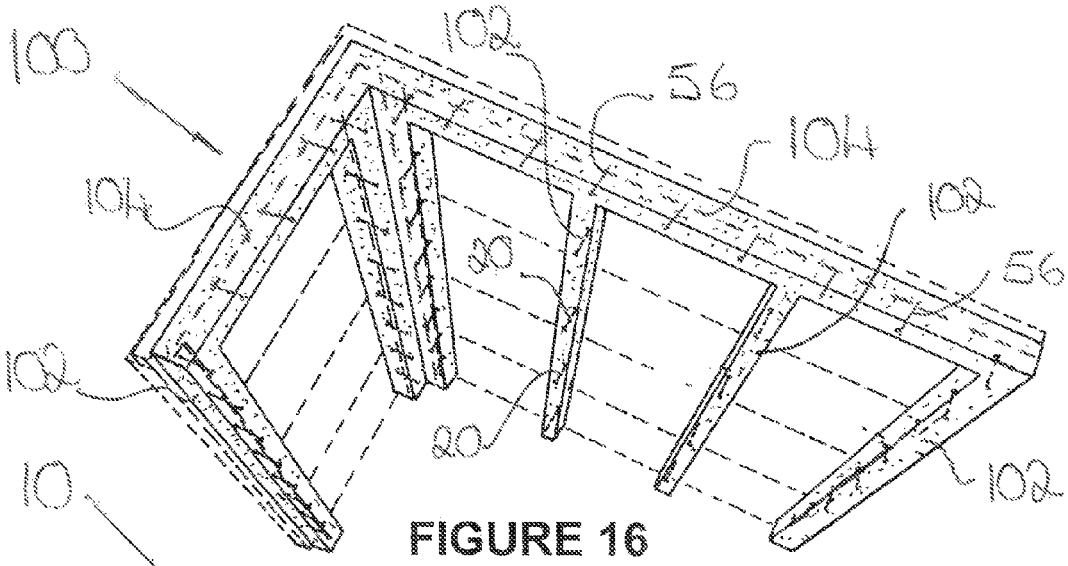
FIG. 16 is an upper perspective view showing a concrete structure formed in the wall assembly of FIG. 15 once concrete has been poured into the formwork, with the remainder of the structure being shown in dotted lines.
Figure 17:
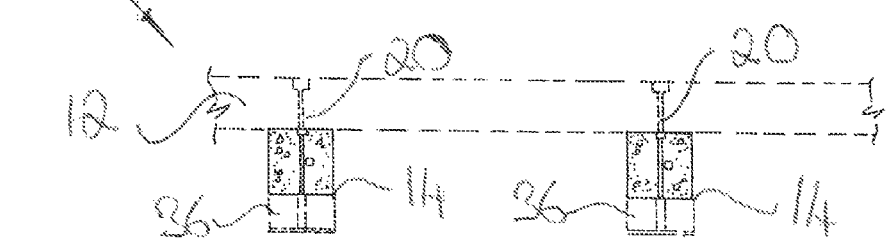
FIG. 17 is a top plan view of the concrete structure of FIG. 16 with other components once again being shown in dotted lines.

FIGS. 16 and 17 illustrate in schematic form how an underlying structural frame of cementitious material, indicated generally by numeral 100 is formed on the slab 80. The structural frame 100 comprises a plurality of spaced vertically extending support posts 102 including a corner post. The corner post is thickened thereby providing increased structural strength at the corner of the wall where it is required. It also includes a horizontally extending structural member, e.g. a support beam, 104 extending along upper ends of the posts 102. These drawings show in particular how the cementitious material surrounds and encloses the connectors 20 in the vertically extending formwork members 14, 16. This braces adjacent cladding members 12 to each other and also braces the formwork members 14, 16 to the cladding members 12. The drawings also show how the cementitious material encloses the connectors 56 in the horizontally extending formwork member 50 to further brace the wall. Further the vertical and horizontal reinforcing rods (not shown) serve to anchor the wall on the slab 80 on which it is mounted.

Further FIG. 17 illustrates clearly how the filler body 36 is used to receive the opposite ends 24 of the connectors 20 so that they do not project out beyond the channel base on the channel members 14. This way an outer surface of the channel base 38 provides a flat support surface suitable for mounting an internal wall liner thereto.

FIGS. 18 to 21 comprise a sequence of schematic drawings which illustrate how a basic rectangular single storey building 110 can be built having an external wall 112 like that described above with reference to the preceding drawings.

Figure 18:
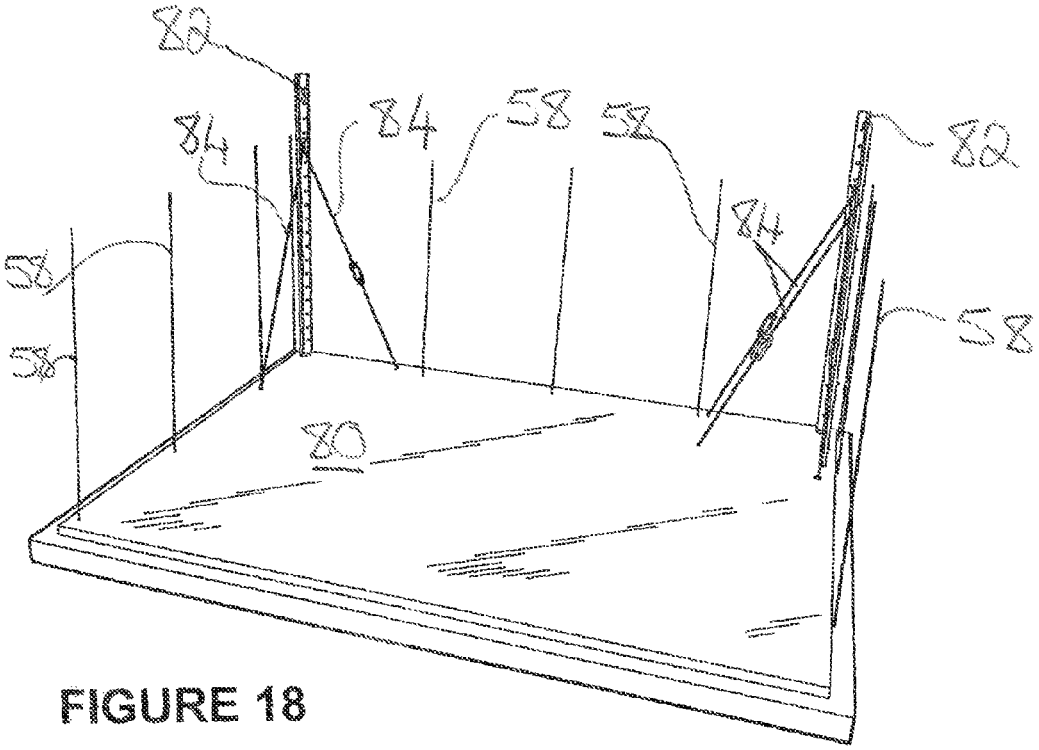
FIG. 18 is a perspective view of a concrete slab with temporary mounting brackets thereon being prepared for construction of a wall assembly.
Figure 19:
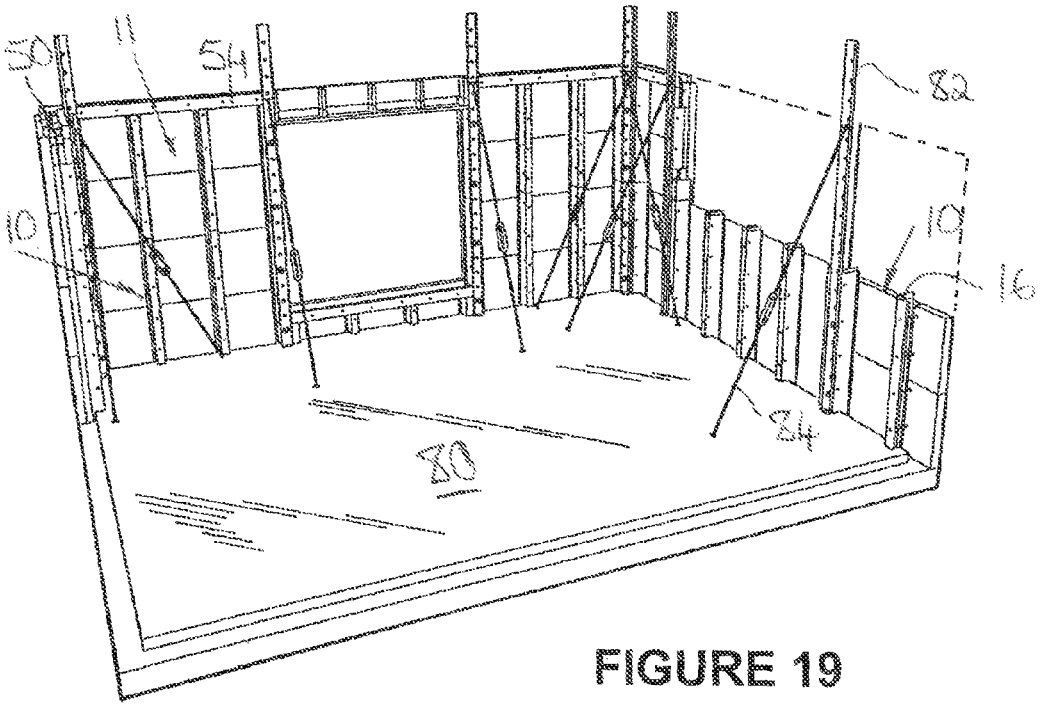
FIG. 19 is a perspective view of a building being constructed with wall units as illustrated in FIGS. 1 to 10 making a wall assembly shown in FIGS. 15 to 17.
Figure 20:
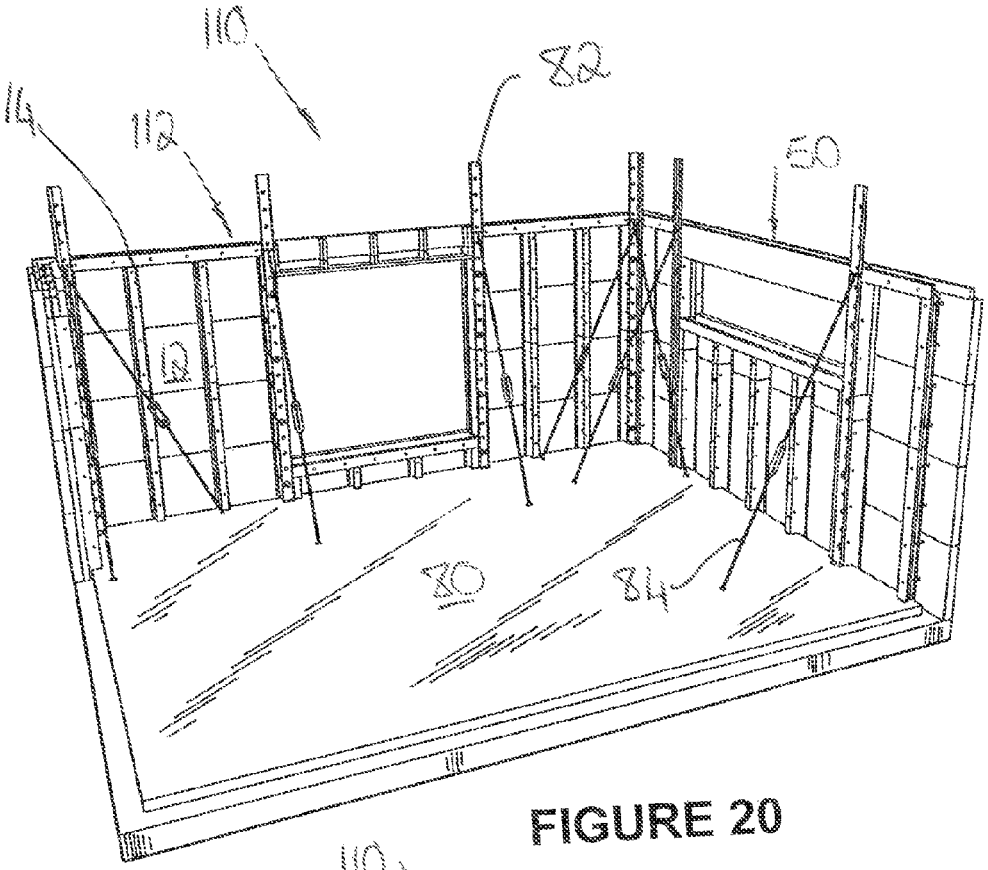
FIG. 20 is a perspective view of the building of FIG. 19 showing the walls in a more advanced state of completion.
Figure 21:
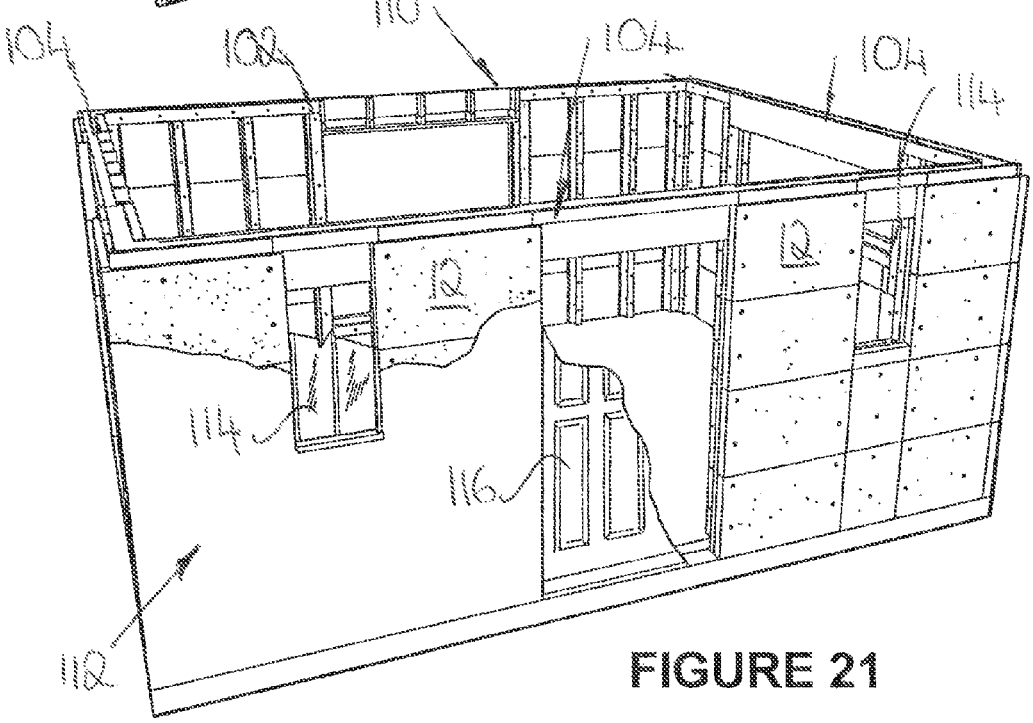
FIG. 21 is a perspective view of the building of FIG. 20 in which the walls have been substantially built and which has doors and windows mounted thereto.

FIG. 18 shows a basic slab 80 for the building 110. The vertical reinforcing rods 58 have been anchored in the concrete slab 80 using known techniques at appropriate positions along the line of the wall 112. Temporary constructions brackets 82 have been placed in position in two of the corners which are supported in an upright position by diagonally extending stays 86. FIG. 19 shows a plurality of wall units 10 placed in position along the line of the wall 112. Basically there are two rows of wall units, namely a lower row of wall units 10 and an upper row of wall units 11. As shown in the drawings connector retainers 74 have been mounted on the construction brackets 82 and the formwork members 14, 16 to brace the wall units 10, 11 for pouring of cementitious material into the formwork space 18. FIG. 21 shows the building 110 in a more advanced state of completion in which the building 110 has windows 114 mounted in some of the window openings and a door 116 mounted in the door opening.

It will readily be appreciated by persons skilled in the art that it is not necessary for the horizontal beam to extend continuously along the full length of the wall assembly. For example depending on engineering design a section of the beam could be substituted with a steel channel, e.g. above a window or a door. The steel channel is lighter than a concrete beam and applicant envisages that is some instances it may be used in preference to the cement beam. FIGS. 19 to 22 illustrate both options as the support above the window on the rear wall is a light steel channel. By contrast the support on the window above the window on the side wall is the concrete beam formed in accordance with this disclosure which extends along the full length of the side as shown in the drawings.

Figures 22, 23:
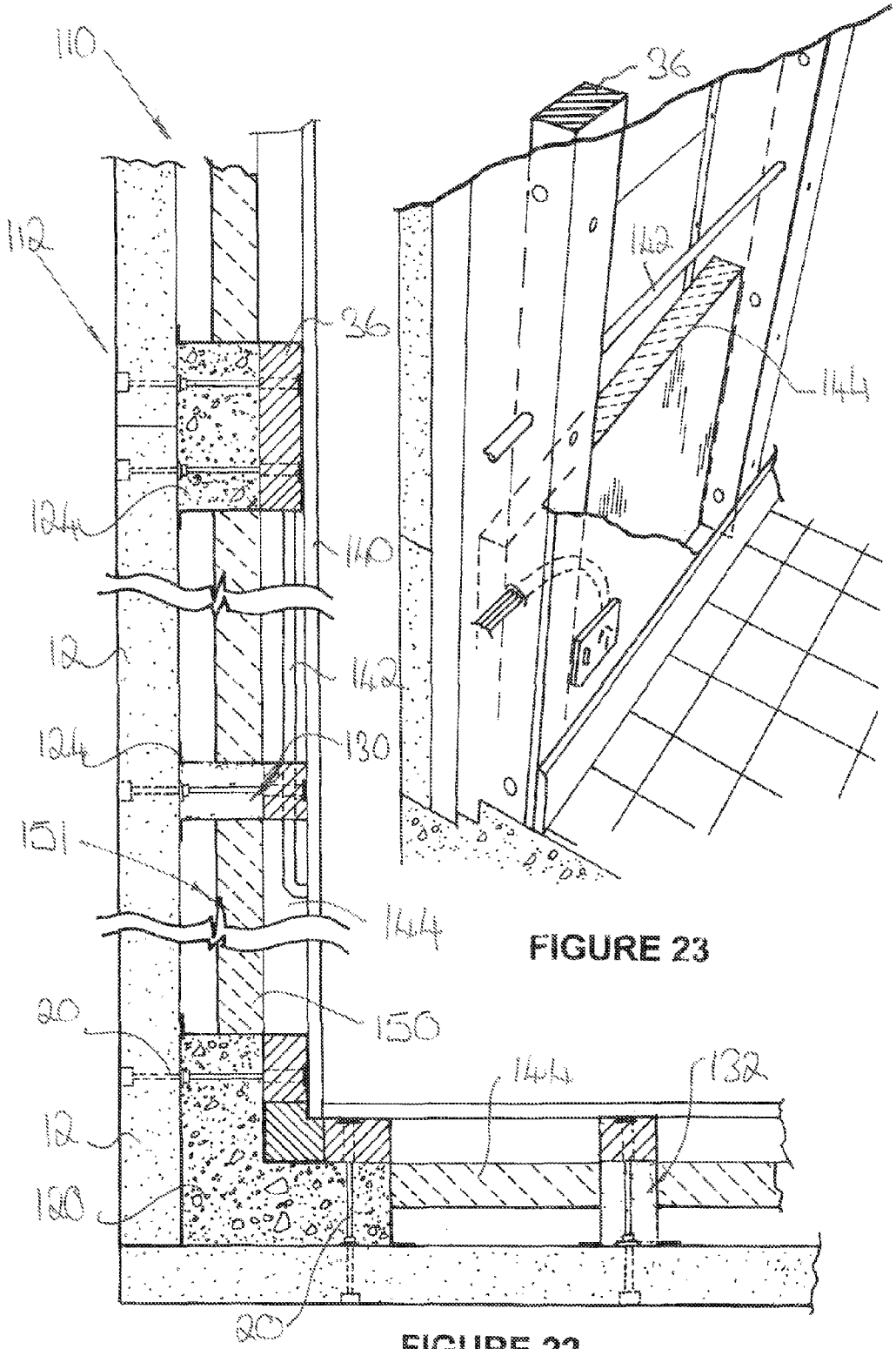
FIG. 22 is a sectional plan view through a part of a wall like that shown in FIG. 21.
FIG. 23 is a perspective view of a part of a wall like that shown in FIG. 21.

FIG. 22 shows a sectional view of a wall assembly of a completed building similar to that in FIG. 21 with the section being taken below the horizontally extending formwork member. FIG. 23 is a perspective view of a part of a wall in a building.

FIGS. 22 and 23 shows a corner post 120 made of cementitious material and a further post 124 at the point where two cladding members abut each other and the wall extends in a straight line. The corner post 120 has two vertical rows of connectors 20 passing through the cementitious material. One row of connectors 20 is fixed to one wall unit 125 and the other row of connectors 20 is fixed to an adjacent wall unit 126. The two rows of connectors 20 are embedded in the same body of cementitious material and this braces the two wall units 125 and 126 to each other. Each wall unit 125 and 126 has a vertical formwork member 130 and 132 that is not filled with a cementitious material. In this case the engineering design has determined that sufficient structural strength is obtained by filling the other formwork members with cementitious material. Naturally if additional structural strength is required in the engineering design then these further formwork members could be designed to receive cementitious material and provide further structural support posts intermediate the existing structural support posts.

In addition FIG. 22 shows an internal wall liner 140 that is a plasterboard, e.g. plasterboard made and sold in Australia by Boral Ltd under the trade mark GYPROCK™. The liner of plasterboard 140 is supplied in sheets of standard thickness and is then cut to size to fit the surface area of the wall being covered. The liner of plasterboard 140 is mounted on the base 38 of the channel members 14 and the cross face 40 of the angle members 16. Both these surfaces 38, 40 provide a flat and generous surface area for the application of the plasterboard liner 140 thereto by fixing elements or by adhesive. The exposed surface of the plasterboard liner 140 can then be painted in the usual way.

Further FIG. 22 also shows service cables and conduits 142 passing through the filler bodies 36 of the vertically extending formwork members 14, 16 and through a service wall cavity 144 defined between the cladding members 12 and the plasterboard liner 140. As shown in the drawing service cables 142 pass through a wall cavity 144 that is adjacent to the plasterboard because they cannot pass through the vertical support posts 102 formed of cementitious material.

Further FIG. 22 also shows wall insulating panels 150 that are received within an insulating member wall space indicated by reference numeral 151 intermediate the adjacent vertically extending formwork members back from the wall cavity 144. The formwork members 14, 16 effectively form a discontinuous insulating member wall space 151 along the length of the wall. Each insulating panel 150 is set back from the internal wall lining 140 so that it is aligned with the cementitious support posts 102. This frees up the service wall cavity 144 adjacent to the internal wall liner 140 to receive the service cables and conduits 142 therein. The wall has high levels of sound and temperature insulation.

Figure 24:
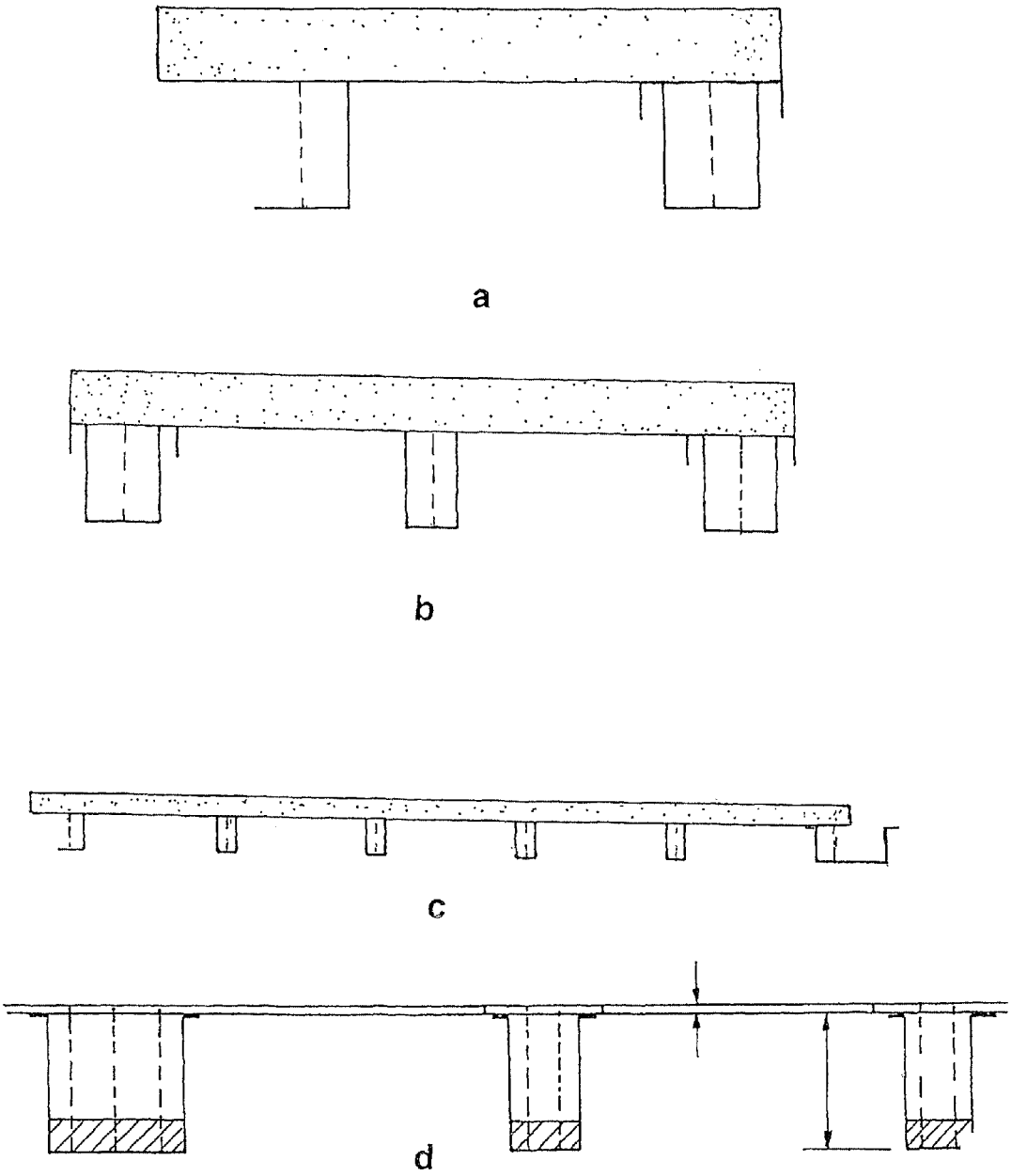
FIG. 24 is a schematic plan view of some example wall units for building a wall assembly and showing how some wall units can have two or more connectors spaced apart across the width of the formwork member.

FIG. 24 is a schematic plan view of several wall units for building a wall assembly like that described above and illustrated in the preceding drawings. The first wall unit has a channel member and an angle member that is spaced from said channel member. The channel member has returns projecting away from each mounting flange 26 and 28. The returns are useful for receiving and interacting with a waterproofing membrane which is folded behind the flanges and returns adjacent a door or window to efficaciously resist the ingress of moisture and wind along the edges of a window or door frame. The angle member 16 is useful for forming a corner in the wall and a corner post as described above.

The second wall unit has three channel members spaced apart along the length of the cladding member. The third wall unit illustrates a channel member 14 at one end thereof that is suitable for forming a support post at a point where two adjacent cladding members, e.g. cladding panels, are connected to each other in a line. The third unit also has a much greater length and number of formwork members than the preceding wall units. The wall unit will be several meters long and has six vertical channel members extending along the length thereof. Naturally a wall unit like this will reduce the amount of labour in positioning and setting the wall units in place on a building site. However the downside is that it is much heavier and more cumbersome to handle both for handling and transport and also for setting it in position on the wall.

The fourth wall unit has plurality of channel formwork members spaced along a length thereof. The cross sectional area of these formwork members 14 is significantly greater than those illustrated in the first three wall units of FIG. 24. One of the channel members 14 has three rows of connectors 20 spaced apart across the transverse width of the channel. This contrasts strongly with the first three units in which each formwork unit only has a single row of connectors across the width of the channel. The other formwork members on this unit have two rows of connectors spaced apart across the transverse width thereof. Further it will be noted that the formwork members in this unit have greater depth or thickness than those in the earlier drawings. This facilitates building a support post with a greater structural strength. Further it will be noted that this increased depth can be compensated for by having a cladding of reduced thickness. This enables the wall unit overall to have the same depth as the other wall units to provide a wall having a standard or consistent wall thickness.

Figure 25:
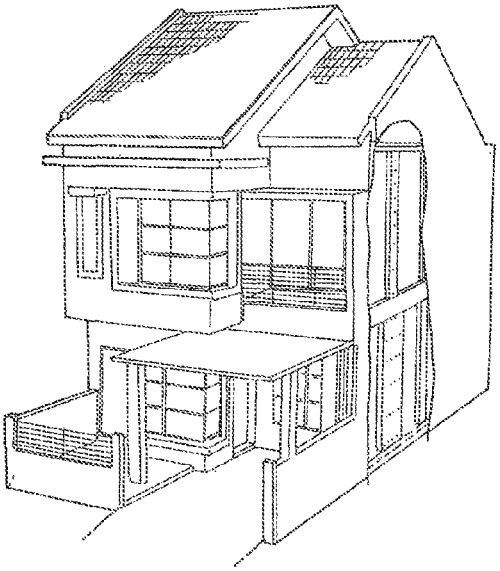
FIG. 25 is a schematic drawing of a double storey house having external wall assemblies built like the wall assemblies described above with reference to FIGS. 1 to 18.

FIG. 25 illustrates a building 110 that is a double storey house that has been built using a wall similar to that described above as the external wall assembly of the house. The external wall 112 of the lower storey is built up in the way described above with reference to the preceding drawings. Concrete is poured into the formwork to form a structure of posts and a concrete beam extending along the top of the posts. Thereafter shuttering is provided adjacent the concrete beam and a suspended slab is poured in the shuttering for the second floor. Once the suspended slab has been completed a further wall assembly can be built on the suspended slab in the same manner as described above for the lower floor.

Figure 26:
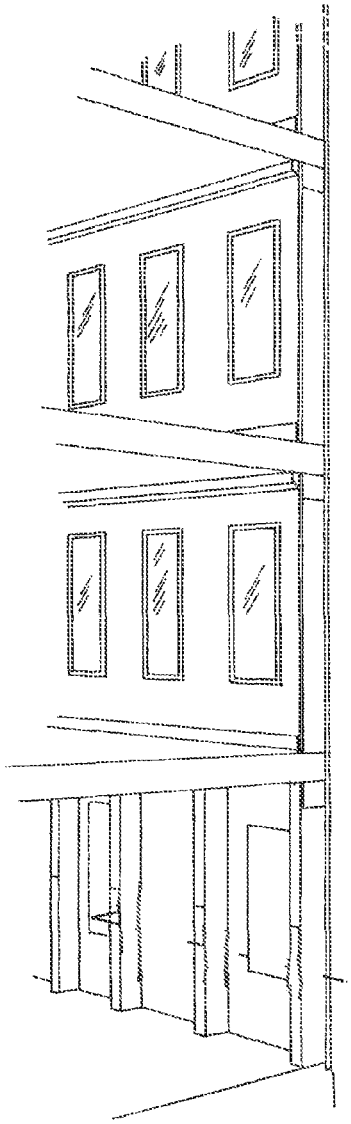
FIG. 26 is a schematic drawing of a multi-storey building structure having wall assemblies on each storey like the wall assemblies described above with reference to FIGS. 1 to 18.
Figure 27:
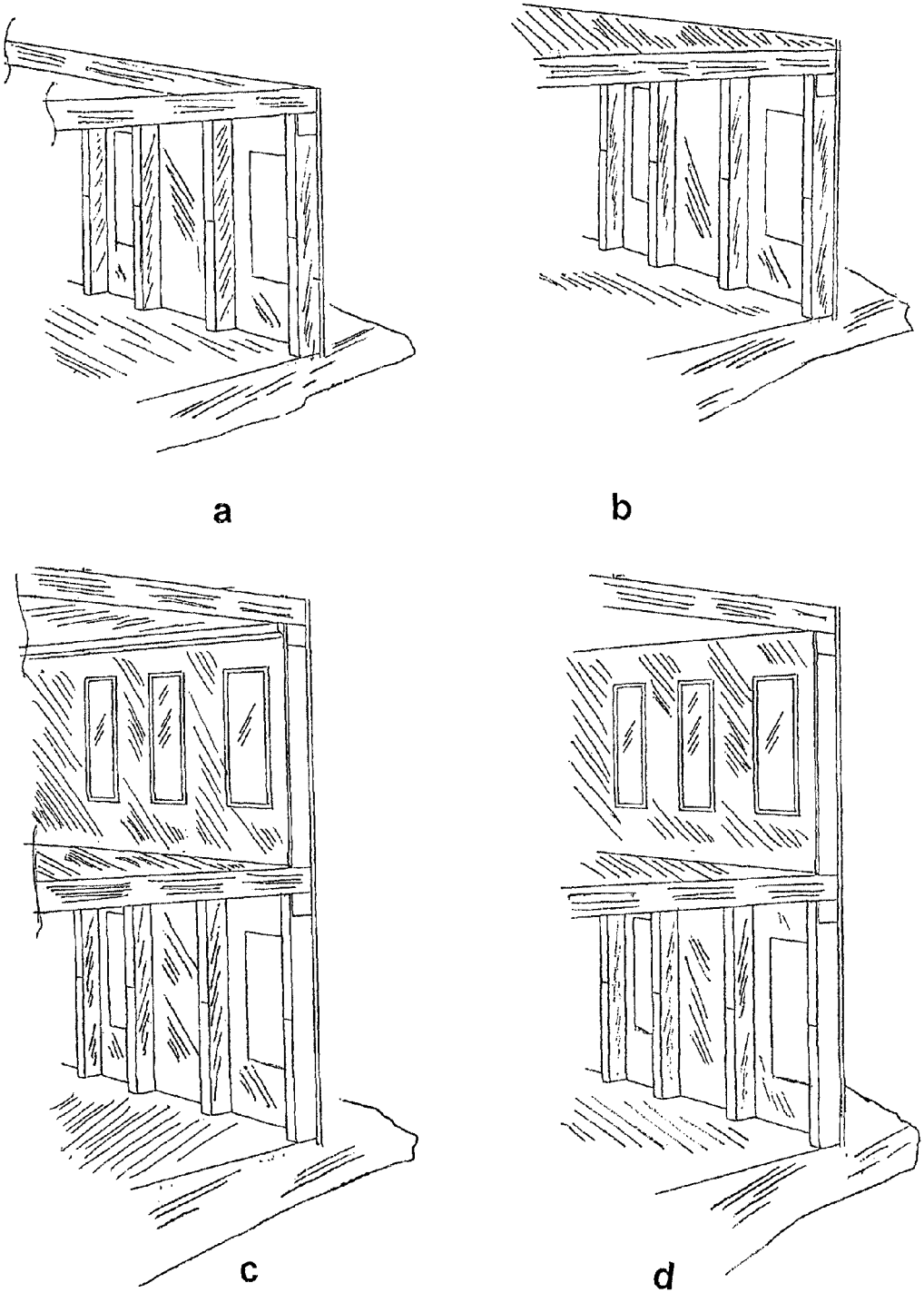
FIG. 27 is a series of schematic drawings showing the multi-storey building is progressively built up.

FIG. 26 is a schematic drawing illustrating a multi-storey building having external wall assemblies as illustrated in the preceding drawings. FIG. 27 is a sequence of drawings showing how the building is progressively in storeys. The multi-storey building is built up repeating the method described immediately above for the double storey house to an appropriate number of times to produce the multi-storey building.

An advantage of the wall assembly described above with reference to the drawings is that it simplifies and speeds up the construction process for building a wall assembly, e.g. for a building such as a house. By manufacturing the building units required for a wall assembly at a factory off-site the work that is required to be done on site is reduced considerably and this reduces costs. Further the construction technique is modular and is easily adapted to wall assemblies and buildings of different sizes. The height of the wall assembly can easily be adapted by adjusting the height of the external cladding member or by adding additional layers of the external cladding member. Further the length of each building unit can be adapted to suit a wall by producing longer building units.

The wall assembly described above combines the following trades in existing construction techniques into one step:

- Construction of an underlying timber or steel structural frame;
- Exterior cladding be it brick or timber or fibre cement sheeting; and
- A plasterboard interior finish.

The provision of these three trades on a building site in Australia is notoriously expensive and by combining these trades substantial savings can be achieved.

Some of the formwork arrangements are formed by channels of steel that are obtained off the shelf as standard profiles of engineering steel. The channel sections and the single external cladding can be used to form the formwork moulds for receiving concrete material. The channels are primarily secured to the outer cladding member by means of threaded connector rods. Additional attachment is provided by screws which are passed through the mounting flanges bearing against the external cladding member and into the material of the external cladding member.

Further the steel channels provide an effective barrier between the inner cladding layer of plasterboard and the cementitious material that is received within the steel channel when concrete is poured into the formwork mould.

A further advantage of the construction technique described above with reference to the drawings is that the vertical concrete piers or posts are joined together by the horizontal beam or top plate that is cast along the top of the wall. This significantly enhances the overall structure. A further advantage is that each window or door opening can be strengthened by having a reinforced concrete pier on each side thereof. A further advantage of the wall assembly described above with reference to the drawings is that the steel channels that are used to form the formwork arrangements are sized and configured to receive typical doors and windows that are widely used on residential housing.

A further advantage of the wall assembly described above with reference to the drawings is that the walls define a wall cavity and the wall cavity is partly filled by an insulated panel such as EPS which is spaced away from on the plasterboard. The insulated panel is mounted in position by being attached to the plaster board. The wall assembly retains a void between the insulating panel and the external cladding member for receiving service conduits.

A further advantage is that the wall assembly described above requires only a single layer of aerated cementitious material and not two such layers. The channel sections of the formwork arrangements act together with a single layer of aerated cementitious material to define the formwork moulds. This considerably reduces costs. The plasterboard can be applied directly to the channel sections which keep it materially separate from the concrete that is received within the channel sections.

A yet further advantage is that the wall assembly and a building can be engineered to have significant strength and to be able to withstand high winds and cyclones. The wall assembly also has excellent thermal and acoustic insulation properties and has a high energy efficiency rating.

It will of course be realized that the above has been given only by way of illustrative examples of the invention and that all such modifications and variations thereto, as would be apparent to persons skilled in the art, are deemed to fall within the broad scope and ambit of the invention as is herein set forth.

The invention claimed is:

1. A wall assembly constructed on a wall support, comprising:

a cladding and at least one formwork member mounted on the wall support, wherein the formwork member is arranged to form at least a part of a formwork defining a formwork space configured to receive a cementitious material therein on site, the cladding also forming a part of the formwork, the formwork member comprising an elongate channel section having a substantially uniform cross-sectional shape having two channel sides joined by a substantially orthogonal channel base, and mounting flanges on the channel sides fixing the formwork member to the cladding, a vertical reinforcing rod mounted on the wall support and received within the formwork member;

at least one elongate connector having two ends, wherein the at least one connector is fixed to the cladding towards one end and to the channel base of the section formwork member towards the other end, and extends through the formwork space and is surrounded by the cementitious material between said one and other ends, wherein the at least one connector is fixed to the reinforcing rod to tie the formwork member and the cladding to the vertical reinforcing rod and thereby the wall support; and a filler body received within the channel section positioned against the channel base spaced from the cladding, wherein the filler body is penetrated by the at least one connector to fix the at least one connector to the formwork member; wherein the formwork member forms a permanent feature of the constructed wall assembly and the at least one connector is surrounded with cementitious material which anchors the connector in the cementitious material.

2. A wall assembly according to claim 1, further comprising an internal wall liner mounted on an outside of the channel base spaced away from the cladding.

3. A wall assembly according to claim 1, wherein the wall assembly includes a plurality of formwork members forming the formwork defining the formwork space, and cementitious material contained in the formwork members forms a plurality of integrally formed elongate structural members.

4. A wall assembly according to claim 1, wherein said at least one formwork member comprises a plurality of substantially vertically extending formwork members that are spaced from each other in a direction of length of the wall assembly, and including at least one substantially horizontally extending formwork member extending in a direction of length of the wall assembly, wherein the horizontal formwork member is arranged so as to form an interconnected formwork and formwork space with the vertically extending formwork members whereby to form a single interconnected structure of cementitious material in the formwork space.

5. A wall assembly according to claim 1, wherein the horizontally extending formwork member includes a horizontal reinforcing rod received in the formwork space and extending in a longitudinal direction of the horizontal formwork member and the horizontal reinforcing rod within the horizontal formwork member is fixed to a plurality of connectors mounted on the horizontal formwork member, and the horizontal reinforcing rod is fixed to one or more of the vertical reinforcing rods thereby to brace the horizontal reinforcing rod to the vertical reinforcing rods and thereby to the wall support.

6. A wall assembly according to claim 1, wherein at least one other formwork member comprises an angle section including a take away face and a cross face at an end of the take away face, and including at least one angle section elongate connector having two ends, the at least one angle section elongate connector being fixed to the cladding towards one end and to the other formwork member towards the other end, and extending through the formwork space.

7. A wall assembly according to claim 6, wherein the formwork member and the at least one other formwork members include fastening elements passing through each mounting flange and into the cladding to fix the formwork member to the cladding for handling and construction.

8. A wall assembly according to claim 6, wherein the at least one other formwork members includes an angle section filler body spaced from the cladding and engaging the at least one connector and fixing the at least one connector to the other formwork member.

9. A wall assembly according to claim 8, wherein at least one filler body in the channel sections or at least one angle section filler body in the angle sections has one or more passages formed therein for receiving the at least one connector therein, and one or more further passages for receiving service conduits and service cables and pipes for providing services on the wall assembly.

10. A wall assembly according to claim 9, wherein the wall assembly further includes an insulating material that is positioned between the wall liner and the cladding, and the insulating material is sized and configured to fit in between adjacent formwork members of the wall assembly along a length of the wall assembly, and the wall assembly further includes a services space adjacent to the wall liner for receiving service conduits and cables therein, and the services space is longitudinally aligned with the filler bodies on said one and other formwork members.

11. A wall assembly according to claim 1, wherein the cladding comprises a plurality of cladding members that are arranged in horizontally extending rows, and each cladding member is mounted to the at least one connector whereby to fix the cladding member to the at least one formwork member, and wherein the cladding members in all of the rows are arranged so that the formwork members in all of the rows are vertically aligned with each other so as to form an interconnected formwork space extending linearly up the wall assembly.

12. A wall assembly according to claim 11, wherein each cladding member has a vertically extending formwork member at each end containing cementitious material, and each said vertically extending formwork member at the ends has at least one further connector extending to and fixed to an adjacent cladding member.

13. A wall assembly according to claim 12, wherein the two adjacent cladding members are oriented so that they extend substantially perpendicularly to each other so as to form a corner in the wall assembly, and each adjacent cladding member has a formwork member that is an angle section mounted thereon, and the two angle sections and the two adjacent cladding members are arranged so as to form a vertically extending formwork space.

14. A wall assembly according to claim 1, wherein said at least one formwork member comprises a plurality of substantially vertically extending formwork members that are spaced from each other along the wall assembly, and at least one substantially horizontally extending formwork member extending along the wall assembly, and the formwork members are arranged so that each formwork member and the cladding forms an interconnected formwork defining an interconnected formwork space, so that the cementitious material within the formwork space forms a structure within the constructed wall assembly, and the wall assembly further comprises a plurality of said connectors extending between each vertical and horizontal formwork member and the cladding, each connector extending from the cladding, through the formwork space where the connector is enclosed by the cementitious material, to the formwork member.

15. A wall assembly according to claim 14, wherein the wall assembly further includes one or more vertical reinforcing bars received within the vertical formwork members that are filled with cementitious material, and a horizontal reinforcing bar received within the horizontal formwork member, and the vertical and horizontal reinforcing bars are fixed to the connectors within the respective formwork members.

16. A wall assembly according to claim 15, wherein the formwork members include one or more channel sections and one or more angle sections, and each formwork member includes a filler body that is spaced from the cladding that is penetrated by the connector to engage the filler body and fix the connector to the formwork member.

17. A wall assembly according to claim 1, wherein each formwork member has a plurality of connectors mounted thereon, and the plurality of connectors are spaced apart in a longitudinal direction of the formwork member.

18. A method of constructing a wall assembly, the method including:

placing a plurality of pre-assembled wall units on a wall support, each pre-assembled wall unit comprising a cladding, at least one formwork member mounted on the cladding, the at least one formwork member comprising an elongate channel section of substantially uniform cross sectional shape including two channel sides joined by a substantially orthogonal channel base, and mounting flanges along the two channel sides fixing the at least one formwork member to the cladding, and at least one elongate connector having two ends, the at least one connector fixed to the cladding towards one end, and fixed to the formwork member towards the other end, and arranging the pre-assembled wall units such that the formwork members and the claddings form a formwork defining a formwork space through which the at least one elongate connector extends;

positioning a vertically extending reinforcing bar within the formwork member and fixing a lower end of the reinforcing bar to the wall support;

fixing the reinforcing bar to the at least one elongate connector within the formwork space;

bracing the formwork members and the cladding with a temporary brace to hold the formwork firmly in position on the wall support by fixing the temporary brace to at least one formwork member and the wall support;

pouring a cementitious material in a flowable form into the formwork space and allowing the cementitious material to set to form an elongated structural member of cast cementitious material within the formwork that encloses the elongate connector and anchors the connector in the cementitious material; and removing the temporary bracing and support after the cementitious material has set while retaining the at least one formwork member which forms a permanent feature of the constructed wall assembly and the connector is surrounded with cementitious material which anchors the connector in the cementitious material.

* * * * *